US007357124B2

(12) United States Patent
Elia et al.

(10) Patent No.: US 7,357,124 B2
(45) **Date of Patent: *Apr. 15, 2008**

(54) MULTIPLE CAPILLARY FUEL INJECTOR FOR AN INTERNAL COMBUSTION ENGINE

(75) Inventors: Mimmo Elia, Watertown, MA (US); Jan-Roger Linna, Boston, MA (US); John Paul Mello, Newton, MA (US)

(73) Assignee: Philip Morris USA Inc., Richmond, VA (US)

( * ) Notice: Subject to any disclaimer, the term of this patent is extended or adjusted under 35 U.S.C. 154(b) by 453 days.

This patent is subject to a terminal disclaimer.

(21) Appl. No.: 10/975,269

(22) Filed: Oct. 28, 2004

(65) Prior Publication Data

US 2007/0056570 A1 Mar. 15, 2007

Related U.S. Application Data

(63) Continuation-in-part of application No. 10/342,267, filed on Jan. 15, 2003, now Pat. No. 6,820,598, which is a continuation-in-part of application No. 10/143,250, filed on May 10, 2002, now Pat. No. 6,779,513.

(60) Provisional application No. 60/515,924, filed on Oct. 30, 2003.

(51) Int. Cl.
*F02B 51/00* (2006.01)

(52) U.S. Cl. ..... 123/549; 123/557; 123/179.21

(58) Field of Classification Search ..... 123/549, 123/557, 304, 179.21; 239/131–133, 135, 239/585.2, 585.4

See application file for complete search history.

(56) References Cited

U.S. PATENT DOCUMENTS 3,716,416 A 2/1973 Adlhart et al.

(Continued)

FOREIGN PATENT DOCUMENTS

DE 482 591 C 2/1930

(Continued)

OTHER PUBLICATIONS

Patent Abstracts of Japan, vol. 2000, No. 07, Sep. 29, 2000 & JP2000 110666 A (Toyota Motor Corp) Apr. 18, 2000 Abstract.

(Continued)

*Primary Examiner*—Marguerite McMahon
(74) *Attorney, Agent, or Firm*—Roberts Mlotkowski & Hobbes

(57) ABSTRACT

A fuel injector for vaporizing a liquid fuel for use in an internal combustion engine. The fuel injector includes a plurality of capillary flow passages, each of the plurality of capillary flow passages having an inlet end and an outlet end; a heat source arranged along each of the plurality of capillary flow passages, the heat source operable to heat the liquid fuel in each of the plurality of capillary flow passages to a level sufficient to change at least a portion thereof from the liquid state to a vapor state and deliver a stream of substantially vaporized fuel from each outlet end of the plurality of capillary flow passages; and a valve for metering substantially vaporized fuel to the internal combustion engine, the valve located proximate to each outlet end of the plurality of capillary flow passages. The fuel injector is effective in reducing cold-start and warm-up emissions of an internal combustion engine.

90 Claims, 9 Drawing Sheets

U.S. PATENT DOCUMENTS 3,731,880 A * 5/1973 Williams ..... 239/585.1
3,868,939 A 3/1975 Friese et al.
3,999,525 A 12/1976 Stumpp et al.
4,034,729 A 7/1977 Omachi et al.
4,057,190 A * 11/1977 Kiwior et al. ..... 239/558
4,210,103 A 7/1980 Dimitroff et al. ..... 123/1 A
4,218,021 A 8/1980 Palma
4,223,652 A 9/1980 Budnicki ..... 123/440
4,344,402 A 8/1982 Child et al. ..... 123/538
4,345,569 A 8/1982 Hattori et al. ..... 129/549
4,356,980 A 11/1982 Krauss
4,395,989 A 8/1983 Eshelman et al. ..... 123/478
4,403,576 A 9/1983 Dimitroff et al. ..... 123/3
4,458,655 A 7/1984 Oza ..... 123/558
4,477,027 A 10/1984 Knapp et al. ..... 239/585
4,483,307 A 11/1984 Gilmor ..... 123/558
4,784,213 A 11/1988 Eager et al.
4,870,932 A 10/1989 Asmus
4,886,032 A 12/1989 Asmus ..... 123/559
4,955,351 A 9/1990 Lewis et al. ..... 123/557
4,958,773 A 9/1990 Stettner et al.
4,958,774 A 9/1990 Taylor
5,040,497 A 8/1991 Dingle
5,054,454 A 10/1991 Hamburg ..... 123/520
5,121,730 A 6/1992 Ausman et al. ..... 123/467
5,195,477 A 3/1993 Hudson, Jr. et al. ..... 123/179.7
5,226,400 A 7/1993 Birch ..... 123/543
5,273,215 A 12/1993 Hans et al.
5,331,937 A 7/1994 Clarke ..... 123/491
5,332,046 A 7/1994 Tanimizu et al.
5,343,848 A 9/1994 Birch et al. ..... 123/557
5,408,967 A 4/1995 Foster ..... 123/294
5,482,023 A 1/1996 Hunt et al. ..... 123/491
5,524,582 A 6/1996 Suh et al. ..... 123/179.8
5,529,035 A 6/1996 Hunt et al. ..... 123/179.15
5,685,494 A 11/1997 Kubach et al.
5,743,251 A 4/1998 Howell et al.
5,758,826 A 6/1998 Nines ..... 239/136
5,813,388 A 9/1998 Cikanek, Jr. et al. ..... 123/549
5,823,444 A 10/1998 Reiter et al.
5,836,289 A 11/1998 Thring ..... 123/549
5,894,832 A 4/1999 Nogi et al. ..... 123/491
5,947,091 A 9/1999 Krohn et al. ..... 123/549
6,026,787 A 2/2000 Sun et al. ..... 123/525
6,067,970 A 5/2000 Awarzamani et al. ..... 123/549
6,067,971 A 5/2000 Cikanek, Jr. et al. ..... 123/549
6,079,636 A 6/2000 Rembold et al.
6,092,743 A * 7/2000 Shibata et al. ..... 239/533.12
6,102,303 A 8/2000 Bright et al. ..... 239/135
6,109,247 A 8/2000 Hunt ..... 123/549
6,119,670 A 9/2000 Lavi
6,145,494 A 11/2000 Klopp ..... 123/525
6,189,516 B1 2/2001 Hei Ma ..... 123/524
6,189,518 B1 2/2001 Cooke ..... 123/549
6,189,803 B1 2/2001 Ganan-Calvo
6,209,309 B1 4/2001 McArthur
6,234,153 B1 5/2001 DeGroot et al. ..... 123/525
6,237,576 B1 5/2001 Buccino et al. ..... 123/549
6,267,307 B1 7/2001 Pontoppidan ..... 239/585.4
6,276,347 B1 8/2001 Hunt ..... 123/549
6,289,881 B1 9/2001 Klopp ..... 123/525
6,332,457 B1 12/2001 Imoehl ..... 123/549
6,354,256 B1 3/2002 Ohanian et al. ..... 123/179.21
6,357,677 B1 3/2002 Ren et al.
6,360,960 B1 3/2002 Nally, Jr. et al.
6,390,076 B2 5/2002 Hunt ..... 123/549
6,499,674 B2 12/2002 Ren et al.
6,502,761 B1 1/2003 Pace et al.
6,550,696 B2 4/2003 Mansour et al.
6,568,390 B2 5/2003 Nichols et al.
6,820,598 B2 * 11/2004 Pellizzari et al. ..... 123/549
2001/0020469 A1 9/2001 Hunt ..... 123/549
2001/0054608 A1 12/2001 Ohkuma et al.
2002/0130193 A1 9/2002 Peterson, Jr.
2002/0130284 A1 9/2002 Knebel et al.
2003/0056790 A1 3/2003 Nichols et al.
2003/0057300 A1 3/2003 Peterson, Jr.
2003/0178011 A1 9/2003 Pellizzari et al. ..... 123/549

FOREIGN PATENT DOCUMENTS

DE 40 22 335 1/1992
DE 195 46 851 6/1997
DE 37 19 234 12/1998
EP 0 849 375 6/1998
EP 0 915 248 5/1999
FR 2 742 811 6/1997
GB 2 147 949 5/1985
JP 58-110854 7/1983
JP 5-141329 6/1993
JP 411-062773 3/1999
WO WO 87/00887 2/1987
WO WO 03/083281 10/2003

OTHER PUBLICATIONS

Boyle R J et al: "Cold Start Performance Of An Automobile Engine Using Prevaporized Gasoline" SAE Technical Paper Series, Society of Automotive Engineers, Warrendale, PA, US, vol. 102, No. 3, 1993, pp. 949-957, XP000564352; ISSN: 0148-7191, p. 950-p. 951.

* cited by examiner

MULTIPLE CAPILLARY FUEL INJECTOR FOR AN INTERNAL COMBUSTION ENGINE

RELATED APPLICATIONS

This patent application claims priority to Provisional Application Ser. No. 60/515,924, filed on Oct. 30, 2003, and is a continuation-in-part of application Ser. No. 10/342,267, filed on Jan. 15, 2003 now U.S. Pat. No. 6,820,598, directed to a Capillary Fuel Injector With Metering Valve for an Internal Combustion Engine, which is a continuation-in-part of application Ser. No. 10/143,250, filed on May 10, 2002 now U.S. Pat. No. 6,779,513, directed to a Fuel Injector for an Internal Combustion Engine, the contents of each are hereby incorporated by reference in their entirety.

FIELD

The present invention relates to fuel delivery in an internal combustion engine.

BACKGROUND

Since the 1970's, port-fuel injected engines have utilized three-way catalysts and closed-loop engine controls in order to seek to minimize $NO_x$, CO, and unburned hydrocarbon emissions. This strategy has proven to be particularly effective during normal operation in which the engine and exhaust components have reached sufficient temperatures. However, in order to achieve desirable conversion efficiencies of $NO_x$, CO, and unburned hydrocarbons, the three-way catalyst must be above its inherent catalyst light-off temperature.

In addition, the engine must be at sufficient temperature to allow for vaporization of liquid fuel as it impinges upon intake components, such as port walls and/or the back of valves. The effectiveness of this process is important in that it provides a proper degree of control over the stoichiometry of the fuel/air mixture and, thus, is coupled to idle quality and the performance of the three-way catalyst, and it ensures that the fuel supplied to the engine is burned during combustion and, thus, eliminates the need for over-fueling to compensate for liquid fuel that does not vaporize sufficiently and/or collects on intake components.

In order for combustion to be chemically complete, the fuel-air mixture must be vaporized to a stoichiometric gas-phase mixture. A stoichiometric combustible mixture contains the exact quantities of air (oxygen) and fuel required for complete combustion. For gasoline, this air-to-fuel ratio is about 14.7:1 by weight. A fuel-air mixture that is not completely vaporized, and/or contains more than a stoichiometric amount of fuel, results in incomplete combustion and reduced thermal efficiency. The products of an ideal combustion process are water ($H_2O$) and carbon dioxide ($CO_2$). If combustion is incomplete, some carbon is not fully oxidized, yielding carbon monoxide (CO) and unburned hydrocarbons (HC).

Under cold-start and warm-up conditions, the processes used to reduce exhaust emissions and deliver high quality fuel vapor break down due to relatively cool temperatures. In particular, the effectiveness of three-way catalysts is not significant below approximately 250° C. and, consequently, a large fraction of unburned hydrocarbons pass unconverted to the environment. Under these conditions, the increase in hydrocarbon emissions is exacerbated by over-fueling required during cold-start and warm-up. That is, since fuel is not readily vaporized through impingement on cold intake manifold components, over-fueling is necessary to create combustible mixtures for engine starting and acceptable idle quality.

The mandates to reduce air pollution worldwide have resulted in attempts to compensate for combustion inefficiencies with a multiplicity of fuel system and engine modifications. As evidenced by the prior art relating to fuel preparation and delivery systems, much effort has been directed to reducing liquid fuel droplet size, increasing system turbulence and providing sufficient heat to vaporize fuels to permit more complete combustion.

However, inefficient fuel preparation at lower engine temperatures remains a problem which results in higher emissions, requiring after-treatment and complex control strategies. Such control strategies can include exhaust gas recirculation, variable valve timing, retarded ignition timing, reduced compression ratios, the use of catalytic converters and air injection to oxidize unburned hydrocarbons and produce an exothermic reaction benefiting catalytic converter light-off.

As indicated, over-fueling the engine during cold-start and warm-up is a significant source of unburned hydrocarbon emissions in conventional engines. It has been estimated that as much as 80 percent of the total hydrocarbon emissions produced by a typical, modern port fuel injected (PFI) gasoline engine passenger car occurs during the cold-start and warm-up period, in which the engine is over-fueled and the catalytic converter is essentially inactive.

Given the relatively large proportion of unburned hydrocarbons emitted during startup, this aspect of passenger car engine operation has been the focus of significant technology development efforts. Furthermore, as increasingly stringent emissions standards are enacted into legislation and consumers remain sensitive to pricing and performance, these development efforts will continue to be paramount. Such efforts to reduce start-up emissions from conventional engines generally fall into two categories: 1) reducing the warm-up time for three-way catalyst systems and 2) improving techniques for fuel vaporization. Efforts to reduce the warm-up time for three-way catalysts to date have included: retarding the ignition timing to elevate the exhaust temperature; opening the exhaust valves prematurely; electrically heating the catalyst; burner or flame heating the catalyst; and catalytically heating the catalyst. As a whole, these efforts are costly and do not address HC emissions during and immediately after cold start.

A variety of techniques have been proposed to address the issue of fuel vaporization. U.S. patents proposing fuel vaporization techniques include U.S. Pat. No. 5,195,477 issued to Hudson, Jr. et al, U.S. Pat. No. 5,331,937 issued to Clarke, U.S. Pat. No. 4,886,032 issued to Asmus, U.S. Pat. No. 4,955,351 issued to Lewis et al., U.S. Pat. No. 4,458,655 issued to Oza, U.S. Pat. No. 6,189,518 issued to Cooke, U.S. Pat. No. 5,482,023 issued to Hunt, U.S. Pat. No. 6,109,247 issued to Hunt, U.S. Pat. No. 6,067,970 issued to Awarzamani et al., U.S. Pat. No. 5,947,091 issued to Krohn et al., U.S. Pat. No. 5,758,826 issued to Nines, U.S. Pat. No. 5,836,289 issued to Thring, and U.S. Pat. No. 5,813,388 issued to Cikanek, Jr. et al.

Other fuel delivery devices proposed include U.S. Pat. No. 3,716,416, which discloses a fuel-metering device for use in a fuel cell system. The fuel cell system is intended to be self-regulating, producing power at a predetermined level. The proposed fuel metering system includes a capillary flow control device for throttling the fuel flow in response to the power output of the fuel cell, rather than to provide improved fuel preparation for subsequent combustion. Instead, the fuel is intended to be fed to a fuel reformer for conversion to $H_2$ and then fed to a fuel cell. In a preferred embodiment, the capillary tubes are made of metal and the capillary itself is used as a resistor, which is in electrical contact with the power output of the fuel cell. Because the flow resistance of a vapor is greater than that of a liquid, the flow is throttled as the power output increases. The fuels suggested for use include any fluid that is easily transformed from a liquid to a vapor phase by applying heat and flows freely through a capillary. Vaporization appears to be achieved in the manner that vapor lock occurs in automotive engines.

U.S. Pat. No. 6,276,347 proposes a supercritical or near-supercritical atomizer and method for achieving atomization or vaporization of a liquid. The supercritical atomizer of U.S. Pat. No. 6,276,347 is said to enable the use of heavy fuels to fire small, light weight, low compression ratio, spark-ignition piston engines that typically burn gasoline. The atomizer is intended to create a spray of fine droplets from liquid, or liquid-like fuels, by moving the fuels toward their supercritical temperature and releasing the fuels into a region of lower pressure on the gas stability field in the phase diagram associated with the fuels, causing a fine atomization or vaporization of the fuel. Utility is disclosed for applications such as combustion engines, scientific equipment, chemical processing, waste disposal control, cleaning, etching, insect control, surface modification, humidification and vaporization.

To minimize decomposition of the fuel, U.S. Pat. No. 6,276,347 proposes keeping the fuel below the supercritical temperature until passing the distal end of a restrictor for atomization. For certain applications, heating just the tip of the restrictor is desired to minimize the potential for chemical reactions or precipitations. This is said to reduce problems associated with impurities, reactants or materials in the fuel stream which otherwise tend to be driven out of solution, clogging lines and filters. Working at or near supercritical pressure suggests that the fuel supply system operate in the range of 300 to 800 psig. While the use of supercritical pressures and temperatures might reduce clogging of the atomizer, it appears to require the use of a relatively more expensive fuel pump, as well as fuel lines, fittings and the like that are capable of operating at these elevated pressures.

Despite these and other advances in the art, there exists a need for injector designs capable of delivering improved vaporization while still meeting critical design requirements such as acceptable pressure drop across the injector, acceptable vaporized fuel flow rate at 100% duty cycle, acceptable liquid fuel flow rate at 100% duty cycle, exhibit minimal heat-up time, possess minimal power requirement, exhibit a linear relationship between duty cycle and vaporized fuel flow and exhibit a linear relationship between duty cycle and liquid fuel flow.

SUMMARY

In one aspect, a fuel injector for vaporizing a liquid fuel for use in an internal combustion engine is provided. The fuel injector includes a plurality of capillary flow passages, each of the plurality of capillary flow passages having an inlet end and an outlet end; a heat source arranged along each of the plurality of capillary flow passages, the heat source operable to heat the liquid fuel in each of the plurality of capillary flow passages to a level sufficient to change at least a portion thereof from the liquid state to a vapor state and deliver a stream of substantially vaporized fuel from each outlet end of the plurality of capillary flow passages; and a valve for metering substantially vaporized fuel to the internal combustion engine, the valve located proximate to each outlet end of the plurality of capillary flow passages.

In another aspect a fuel system for use in an internal combustion engine is provided. The fuel system includes a plurality of fuel injectors, each injector including a plurality of capillary flow passages, each of the plurality of capillary flow passages having an inlet end and an outlet end, a heat source arranged along each of the plurality of capillary flow passages, the heat source operable to heat the liquid fuel in each of the plurality of capillary flow passages to a level sufficient to change at least a portion thereof from the liquid state to a vapor state and deliver a stream of substantially vaporized fuel from each outlet end of the plurality of capillary flow passages and a valve for metering substantially vaporized fuel to the internal combustion engine, the valve located proximate to each outlet end of the plurality of capillary flow passages, a liquid fuel supply system in fluid communication with the plurality of fuel injectors, and a controller to control the supply of fuel to the plurality of fuel injectors.

In yet another aspect, a method of delivering fuel to an internal combustion engine is provided. The method includes the steps of supplying liquid fuel to a plurality of capillary flow passages of a fuel injector, causing a stream of substantially vaporized fuel to pass through each outlet of the plurality of capillary flow passages by heating the liquid fuel in the plurality of capillary flow passages, and metering the substantially vaporized fuel to a combustion chamber of the internal combustion engine through a valve located proximate to each outlet of the plurality of capillary flow passages.

In still yet another aspect, a method of delivering vaporized fuel to an internal combustion engine is provided. The method includes the steps of supplying liquid fuel to a plurality of capillary flow passages of a fuel injector, heating the liquid fuel within the plurality of capillary flow passages of the fuel injector and causing vaporized fuel to pass through each outlet of the plurality of capillary flow passages and metering the vaporized fuel to a combustion chamber of the internal combustion engine through a valve located downstream of each outlet of the plurality of capillary flow passages.

The fuel injectors provided are effective in reducing cold-start and warm-up emissions of an internal combustion engine. Efficient combustion can be promoted by forming an aerosol of fine droplet size when the substantially vaporized fuel condenses in air. The substantially vaporized fuel can be supplied directly or indirectly to a combustion chamber of an internal combustion engine during cold-start and warm-up of the engine, or at other periods during the operation of the engine, and reduced emissions can be achieved due to the capacity for improved mixture control during cold-start, warm-up and transient operation.

The capillary passage can be formed within a capillary tube and the heat source can include a resistance heating element or a section of the tube heated by passing electrical current therethrough. The fuel supply can be arranged to deliver pressurized or non-pressurized liquid fuel to the flow passage. The fuel injectors can provide a stream of vaporized fuel that mixes with air and forms an aerosol having a mean droplet size of 25 μm or less.

BRIEF DESCRIPTION OF THE DRAWINGS

The invention will now be described in more detail with reference to preferred forms of the invention, given only by way of example, and with reference to the accompanying drawings, in which.

DETAILED DESCRIPTION OF THE PREFERRED EMBODIMENTS

Figure 1:
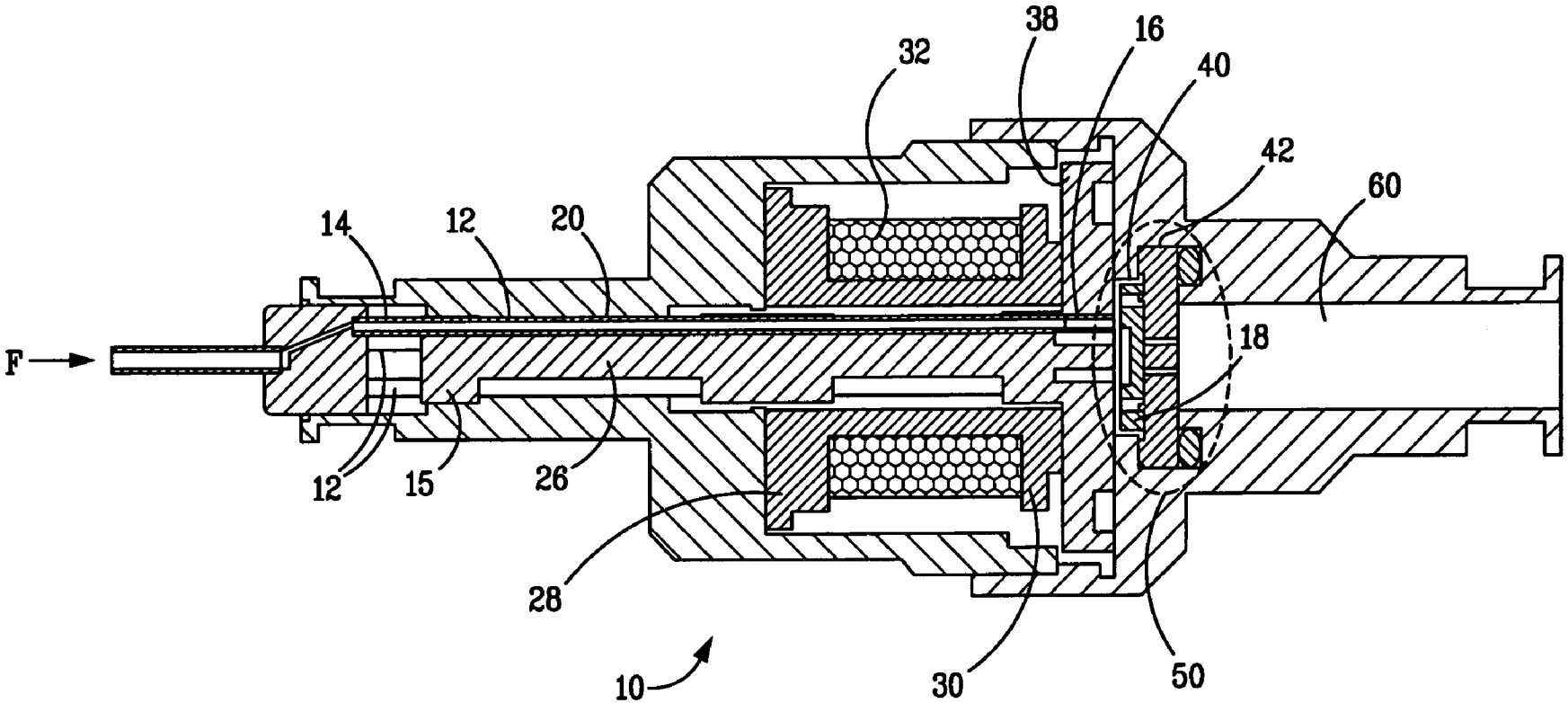
FIG. 1 illustrates a multiple capillary fuel injector, in partial cross section, having an electronically heated capillary bundle positioned upstream of a solenoid activated fuel metering valve, in accordance with a preferred form.

Reference is now made to the embodiments illustrated in FIGS. 1-12 wherein like numerals are used to designate like parts throughout.

Provided herein is a multiple capillary fuel injector with metering valve and a fuel system employing same that is useful for cold-start, warm-up and normal operation of an internal combustion engine. The fuel system includes a fuel injector having a plurality of capillary flow passages, each capillary flow passage capable of heating liquid fuel so that substantially vaporized fuel is supplied when desired. The substantially vaporized fuel can be combusted with reduced emissions compared to conventional fuel injector systems. The fuel delivery system of the present invention requires less power, and has shorter warm-up times than other vaporization techniques.

The injector designs provided herein are specifically aimed at meeting several automotive fuel injector design requirements including: provide an acceptable pressure drop across the injector body, provide an acceptable vaporized fuel flow rate at 100% duty cycle, provide an acceptable liquid fuel flow rate at 100% duty cycle, exhibit minimal heat-up time, possess minimal power requirement, exhibit a linear relationship between duty cycle and vaporized fuel flow and exhibit a linear relationship between duty cycle and liquid fuel flow.

As is well-known, gasoline does not readily vaporize at low temperatures. During the cold start and warm-up period of an automotive engine, relatively little vaporization of the liquid fuel takes place. As such, it is necessary to provide an excess of liquid fuel to each cylinder of the engine in order to achieve an air/fuel mixture that will combust. Upon ignition of the fuel vapor, which is generated from the excess of liquid fuel, combustion gases discharged from the cylinders include unburned fuel and undesirable gaseous emissions. However, upon reaching normal operating temperature, the liquid fuel readily vaporizes, so that less fuel is needed to achieve an air/fuel mixture that will readily combust. Advantageously, upon reaching normal operating temperature, the air/fuel mixture can be controlled at or near stoichiometry, thereby reducing emissions of unburned hydrocarbons and carbon monoxide. Additionally, when fueling is controlled at or near stoichiometry, just enough air is available in the exhaust stream for simultaneous oxidation of unburned hydrocarbons and carbon monoxide and reduction of nitrogen oxides over a three-way catalyst (TWC) system.

The fuel injector and fuel system disclosed herein injects fuel that has been substantially vaporized into the intake flow passage, or directly into an engine cylinder, thereby eliminating the need for excess fuel during the start-up and warm-up period of an engine. The fuel is preferably delivered to the engine in a stoichiometric or fuel-lean mixture, with air, or air and diluent, so that virtually all of the fuel is burned during the cold start and warm-up period.

With conventional port-fuel injection, over-fueling is required to ensure robust, quick engine starts. Under fuel-rich conditions, the exhaust stream reaching the three-way catalyst does not contain enough oxygen to oxidize the excess fuel and unburned hydrocarbons as the catalyst warms up. One approach to address this issue is to utilize an air pump to supply additional air to the exhaust stream upstream of the catalytic converter. The objective is to generate a stoichiometric or slightly fuel-lean exhaust stream that can react over the catalyst surface once the catalyst reaches its light-off temperature. In contrast, the system and method of the present invention enables the engine to operate at stoichiometric or even slightly fuel-lean conditions during the cold-start and warm-up period, eliminating both the need for over-fueling and the need for an additional exhaust air pump, reducing the cost and complexity of the exhaust after treatment system.

As mentioned, during the cold start and warm-up period, the three-way catalyst is initially cold and is not able to reduce a significant amount of the unburned hydrocarbons that pass through the catalyst. Much effort has been devoted to reducing the warm-up time for three-way catalysts, to convert a larger fraction of the unburned hydrocarbons emitted during the cold-start and warm-up period. One such concept is to deliberately operate the engine very fuel-rich during the cold-start and warm-up period. Using an exhaust air pump to supply air in this fuel-rich exhaust stream, a combustible mixture can be generated which is burned either by auto-ignition or by some ignition source upstream of, or in, the catalytic converter. The exotherm produced by this oxidation process significantly heats up the exhaust gas and the heat is largely transferred to the catalytic converter as the exhaust passes through the catalyst. Using the system and method of the present invention, the engine could be controlled to operate alternating cylinders fuel-rich and fuel-lean to achieve the same effect but without the need for an air pump. For example, with a four-cylinder engine, two cylinders could be operated fuel-rich during the cold-start and warm-up period to generate unburned hydrocarbons in the exhaust. The two remaining cylinders would be operated fuel-lean during cold-start and warm-up, to provide oxygen in the exhaust stream.

The system and method of the present invention may also be utilized with gasoline direct injection engines (GDI). In GDI engines, the fuel is injected directly into the cylinder as a finely atomized spray that evaporates and mixes with air to form a premixed charge of air and vaporized fuel prior to ignition. Contemporary GDI engines require high fuel pressures to atomize the fuel spray. GDI engines operate with stratified charge at part load to reduce the pumping losses inherent in conventional indirect injected engines. A stratified-charge, spark-ignited engine has the potential for burning lean mixtures for improved fuel economy and reduced emissions. Preferably, an overall lean mixture is formed in the combustion chamber, but is controlled to be stoichiometric or slightly fuel-rich in the vicinity of the spark plug at the time of ignition. The stoichiometric portion is thus easily ignited, and this in turn ignites the remaining lean mixture. While pumping losses can be reduced, the operating window currently achievable for stratified charge is limited to low engine speeds and relatively light engine loads. The limiting factors include insufficient time for vaporization and mixing at higher engine speeds and insufficient mixing or poor air utilization at higher loads. By providing vaporized fuel, the system and method of the present invention can widen the operating window for stratified charge operation, solving the problem associated with insufficient time for vaporization and mixing. Advantageously, unlike conventional GDI fuel systems, the fuel pressure employed in the practice of the present invention can be lowered, reducing the overall cost and complexity of the fuel system.

The invention provides a fuel delivery device for an internal combustion engine which includes a pressurized liquid fuel supply that supplies liquid fuel under pressure, a plurality of capillary flow passages connected to the liquid fuel supply, and a heat source arranged along the plurality of capillary flow passages. The heat source is operable to heat liquid fuel in the at least one capillary flow passage sufficiently to deliver a stream of substantially vaporized fuel. The fuel delivery device is preferably operated to deliver the stream of vaporized fuel to one or more combustion chambers of an internal combustion engine during start-up, warm-up, and other operating conditions of the internal combustion engine. If desired, the plurality of capillary flow passages can be used to deliver liquid fuel to the engine under normal operating conditions.

The invention also provides a method of delivering fuel to an internal combustion engine, including the steps of supplying the pressurized liquid fuel to a plurality of capillary flow passages, and heating the pressurized liquid fuel in the plurality of capillary flow passages sufficiently to cause a stream of vaporized fuel to be delivered to at least one combustion chamber of an internal combustion engine during start-up, warm-up, and other operating conditions of the internal combustion engine.

A fuel delivery system according to the invention includes a plurality of capillary-sized flow passage through which pressurized fuel flows before being injected into an engine for combustion. Capillary-sized flow passages can be provided with a hydraulic diameter that is preferably less than 2 mm, more preferably less than 1 mm, and most preferably less than 0.75 mm. Hydraulic diameter is used in calculating fluid flow through a fluid carrying element. Hydraulic radius is defined as the flow area of the fluid-carrying element divided by the perimeter of the solid boundary in contact with the fluid (generally referred to as the "wetted" perimeter). In the case of a fluid carrying element of circular cross section, the hydraulic radius when the element is flowing full is $(\pi D^2/4)/\pi D=D/4$. For the flow of fluids in noncircular fluid carrying elements, the hydraulic diameter is used. From the definition of hydraulic radius, the diameter of a fluid-carrying element having circular cross section is four times its hydraulic radius. Therefore, hydraulic diameter is defined as four times the hydraulic radius.

When heat is applied along the capillary passageways, at least a portion of the liquid fuel that enters the flow passages is converted to a vapor as it travels along the passageway. The fuel exits the capillary passageways as a vapor, which optionally contains a minor proportion of heated liquid fuel that has not been vaporized. By substantially vaporized, it is meant that at least 50% of the volume of the liquid fuel is vaporized by the heat source, more preferably at least 70%, and most preferably at least 80% of the liquid fuel is vaporized. Although it may be difficult to achieve 100% vaporization due to the complex physical effects that take place, nonetheless complete vaporization would be desirable. These complex physical effects include variations in the boiling point of the fuel since the boiling point is pressure dependent and pressure can vary in the capillary flow passage. Thus, while it is believed that a major portion of the fuel reaches the boiling point during heating in the capillary flow passage, some of the liquid fuel may not be heated enough to be fully vaporized with the result that a portion of the liquid fuel passes through the outlet of the capillary flow passage along with the vaporized fluid.

Each capillary-sized fluid passage is preferably formed within a capillary body such as a single or multilayer metal, ceramic or glass body. Each passage has an enclosed volume opening to an inlet and an outlet, either of which, or both, may be open to the exterior of the capillary body or may be connected to another passage within the same body or another body or to fittings. The heater can be formed using a portion of the body; for example, a section of a stainless steel or Inconel tube or the heater can be a discrete layer or wire of resistance heating material incorporated in or on the capillary body. Each fluid passage may be any shape comprising an enclosed volume opening to an inlet and an outlet and through which a fluid may pass. Each fluid passage may have any desired cross-section with a preferred cross-section being a circle of uniform diameter. Other capillary fluid passage cross-sections include non-circular shapes such as triangular, square, rectangular, oval or other shape and the cross section of the fluid passage need not be uniform. In the case where the capillary passages are defined by metal capillary tubes, each tube can have an inner diameter of 0.01 to 3 mm, preferably 0.1 to 1 mm, most preferably 0.3 to 0.75 mm. Alternatively, the capillary passages can be defined by transverse cross sectional area of the passage, which can be $8\times10^{-5}$ to 7 $mm^2$, preferably $8\times10^{-3}$ to $8\times10^{-1}$ $mm^2$ and more preferably $7\times10^{-2}$ to $4.5\times10^{-1}$ $mm^2$. Many combinations of multiple capillaries, various pressures, various capillary lengths, amounts of heat applied to the capillary, and different cross-sectional areas will suit a given application.

The liquid fuel can be supplied to the capillary flow passage under a pressure of at least 10 psig, preferably at least 20 psig. In the case where each capillary flow passage is defined by the interior of a stainless steel or Inconel tube having an internal diameter of approximately 0.020 to 0.030 inches and a length of approximately 1 to 3 inches, the fuel is preferably supplied to the capillary passageway at a pressure of 100 psig or less to achieve mass flow rates required for stoichiometric start of a typical size automotive engine cylinder (on the order of 100-200 mg/s). With two to four capillary passageways of the type described herein, a sufficient flow of substantially vaporized fuel can be provided to ensure a stoichiometric or nearly stoichiometric mixture of fuel and air. It is important that each capillary tube be characterized as having a low thermal inertia, so that each capillary passageway can be brought up to the desired temperature for vaporizing fuel very quickly, preferably within 2.0 seconds, more preferably within 0.5 second, and most preferably within 0.1 second, which is beneficial in applications involving cold starting an engine. The low thermal inertia also could provide advantages during normal operation of the engine, such as by improving the responsiveness of the fuel delivery to sudden changes in engine power demands.

In order to meter fuel through the low thermal inertia capillary passages described herein, a valve arrangement effective to regulate vapor flow from the distal end of a fuel injector is required. Because of the small thermal mass of capillary flow passages contemplated herein, the valve arrangement used to regulate vapor flow must be designed to add minimal thermal mass to the heated system so that warm-up time and effectiveness is not degraded. Likewise, the surface area wetted by the fuel must be minimized so that the vaporized fuel does not re-condense on contact and jeopardize performance.

The preferred forms described below each allow for the pulsed delivery of fuel vapor and provide the capacity to switch over to liquid fuel injection. In each of the forms herein described, the vapor flow path through the capillary flow passages is actively heated such that the working fluid is in the vapor phase upon coming into contact with the valve. It is preferred that the valve itself not be actively heated.

FIG. 1 presents one embodiment of a fuel injector 10 for vaporizing liquid fuel drawn from a source of liquid fuel F. A capillary bundle 15 is shown having a plurality of capillary flow passages 12, each having an inlet end 14 and an outlet end 16, with the inlet end 14 in fluid communication with the liquid fuel source F for introducing the liquid fuel in a substantially liquid state into the capillary flow passages 12.

As is preferred, a low-mass plate valve assembly 18 is operated by solenoid 28. Solenoid 28 has coil windings 32 connected to electrical connector (not shown). When the coil windings 32 are energized, a magnetic field is directed through the metering plate 40, thereby causing it to lift. When electricity is cut off from the coil windings 32, a spring (not shown) returns the metering plate 40 to its original position In an alternate embodiment, a solenoid element (not shown) could be drawn into the center of coil windings 32 to lift metering plate 40, which could be connected to the solenoid element. Movement of the solenoid element, caused by applying electricity to the coil windings 32, would cause the metering plate 40 to be drawn away from an orifice plate 42, allowing fuel to flow (see FIG. 5A). Again, when electricity is cut off from the coil windings 32, a spring (not shown) returns the metering plate 40 to its original position.

A heat source 20 is arranged along each capillary flow passage 12. As is most preferred, each heat source 20 is provided by forming capillary flow passage 12 from a tube of electrically resistive material, a portion of each capillary flow passage 12 forming a heater element when a source of electrical current is connected to the tube for delivering current therethrough. Each heat source 20, as may be appreciated, is then operable to heat the liquid fuel in each capillary flow passage 12 to a level sufficient to change at least a portion thereof from a liquid state to a vapor state and deliver a stream of substantially vaporized fuel from outlet end 16 of each capillary flow passage 12. As may be appreciated, this method of vapor delivery within the body of the injector minimizes the volume of material that comes into contact with the vaporized fuel and, therefore, also minimizes the thermal mass that must be heated in order to prevent premature condensation of the vapor.

As is preferred, capillary bundle 15 may consist of from 2 to 4 thin-walled capillary flow passages 12 (0.032" outer diameter (OD) and 0.028-0.029" inner diameter (ID)). Capillary flow passages 12 may be constructed from stainless steel or annealed Inconel 600 tubes, each having a heated length 20 of from about 1.25" to about 2.50". When current is supplied to capillary bundle 15, the heated source 20 of each capillary passage 12 becomes hot and subsequently vaporizes fuel as the fuel flows through the capillary passages 12.

Upon exiting the outlet ends 16 of capillary passages 12, fuel flow is directed toward metering section 50 of fuel injector 10. As indicated above, as with conventional fuel injectors, the metering section 50 consists of a solenoid operated metering valve, which in this embodiment is of the flat plate type with a metering plate 40 as a moving member that opens or closes the flow passage through the orifice plate 42. The act of actuating the solenoid 28 to move the metering plate 40 between the open and closed position serves to meter the flow of fuel exiting the injector 10.

Upon exiting the metering plate 40, the fuel flows through an orifice plate 42. In the case of liquid fuel injection, orifice plate 42 serves to create the desired spray atomization and spray angle. As shown in FIG. 1, a chimney section 60 is included to further direct the exiting fuel stream and also allow the injector 10 to satisfy overall length requirements of conventional port fuel injectors.

Electrical connections are made such that four spade connections are molded into the bobbin 30. Two of the connections serve to power the solenoid 28. An additional connection is attached to the top of the capillary bundle 15. The final connection is embedded through the bobbin 30 and terminates at the bottom of the bobbin 30 such that a connection may be made with the distal end of the capillary bundle 15.

Figure 2:
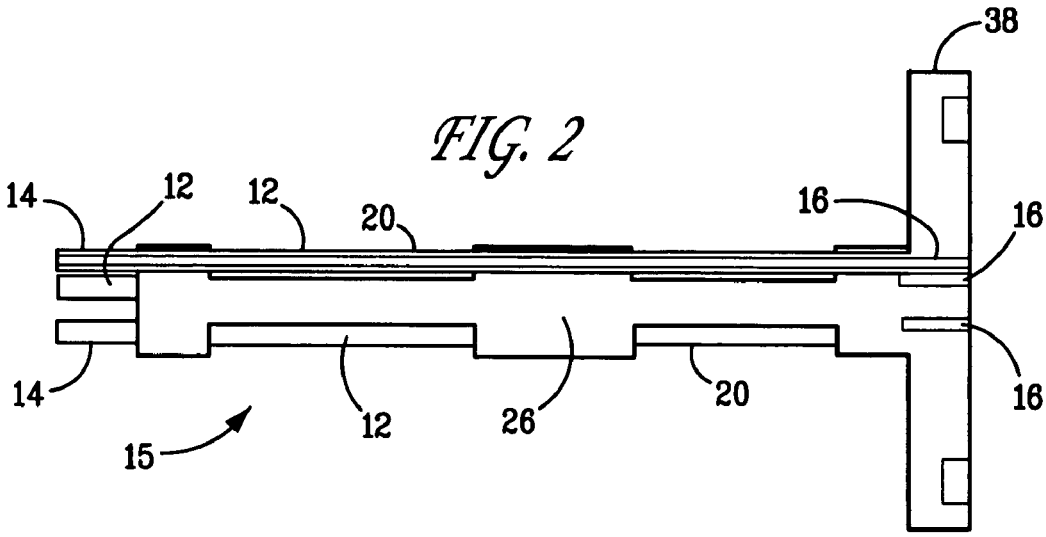
FIG. 2 presents an enlarged view of the capillary bundle of the FIG. 1 embodiment.

FIG. 2 shows an enlarged view of capillary bundle 15 of the FIG. 1 embodiment. As shown, the capillary passages 12 are held in place with a spindle piece 26, which may have any of several geometries, provided that the spindle piece 26 structurally supports the capillary passages 12 without introducing additional thermal inertia to the capillary passages 12. The spindle piece 26 may also function as part of the electrical path used to power the heater formed by the heated length 20 capillary passages 12. As shown, spindle piece 26 includes spindle end 38, which is positioned to engage the outlet ends 16 of capillary passages 12 of capillary bundle 15.

Various methods to attach the capillary bundle 15 in the region of the metering section 50 are contemplated. One method is through the use of laser welding. Specifically, the capillary passages 12 are laser welded onto a securing disk, where the capillary passages 12 extend through the thickness of the disk. This securing disk is then welded to the inner diameter of the passage that extends down the centerline of the injector 10. As may be appreciated, the capillary passages 12 are secured in position through this welding process. Although this method of attachment does not result in thermal isolation of the capillaries from the metal portion of the injector 10, the resultant increase in thermal mass is not considered to be significant since the flow path is relatively small (i.e., the point of connection between the securing disk and the centerline passage is small). However, it should be recognized that a thermally insulating material could also be used to hold the securing disk in place.

Another method of attaching the capillary bundle 15 in the region of the metering section 50 is through the use of a brazing technique. Through this technique, a cup-and-disk apparatus is used to secure the outlet ends 16 of the capillary passages 12 in place. The cup portion of this assembly consists of a short cylindrical piece of metal, into which the outlet ends 16 of the capillary passages 12 are fit. The ends of the capillary passages are then brazed to the inner diameter of the cup. The end of the cup closest to the metering section 50 is flared out such that it is perpendicular to the axis of the cylinder. This cup portion is then brazed to the inner diameter of a separate disk. A separate method is used to ensure that there is no fluid flow path between the disk and the fuel injector housing. Some examples of such methods include the use of a soft weld to create a physical connection between the disk and the fuel injector housing or the use of an O-ring. It should be noted that the non-magnetic property of the braze, the magnetic properties of the cup and the disk, and the orientation and thickness of each piece in this assembly are designed to act as part of the magnetic circuit of the fuel injector 10.

Figure 3A:
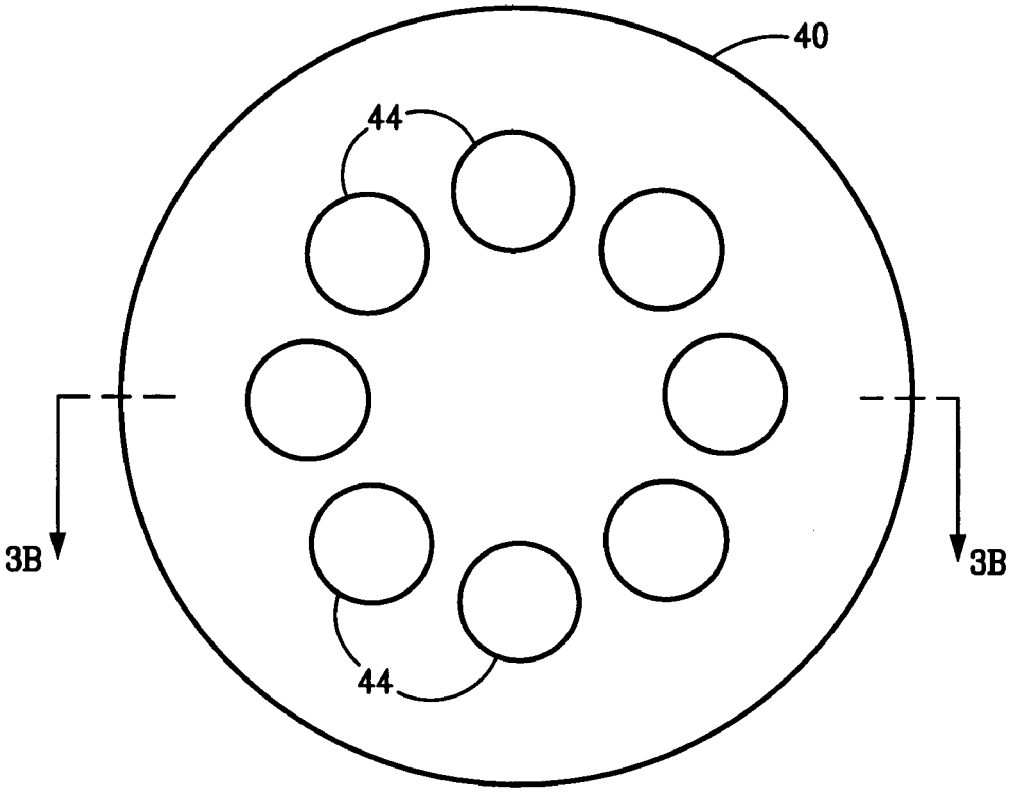
FIG. 3A presents a plan view of a preferred form of metering plate 40.
Figure 3B:
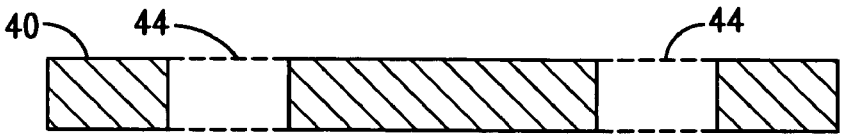
FIG. 3B presents a cross-sectional view taken through line 3B-3B of FIG. 3A.

FIG. 3A presents a plan view of a preferred embodiment of metering plate 40. As shown, metering plate 40 includes a plurality of metering apertures 44 to permit the flow of fuel to pass from the outlet ends 16 of capillary passages 12 of capillary bundle 15. FIG. 3B presents a cross-sectional view taken through line 3B-3B of FIG. 3A. As indicated, metering plate 40 serves as a moving member that opens or closes the fuel flow path through the orifice plate 42, as will be detailed below.

Figure 4A:
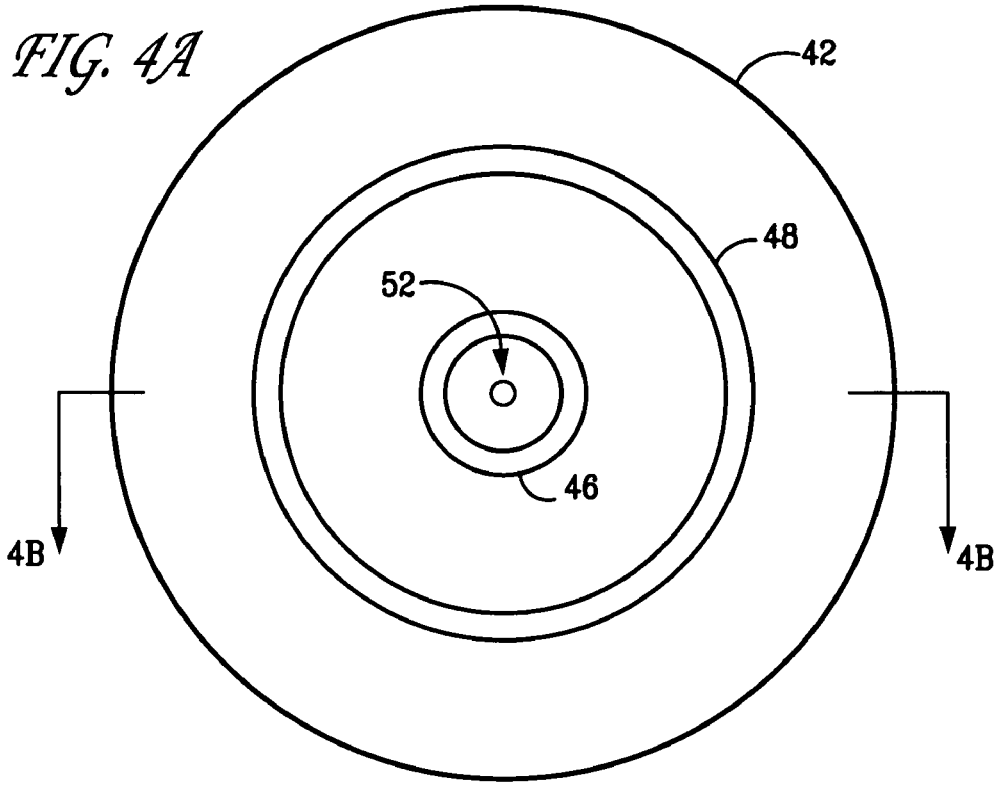
FIG. 4A presents a plan view of a preferred form of orifice plate.
Figure 4B:
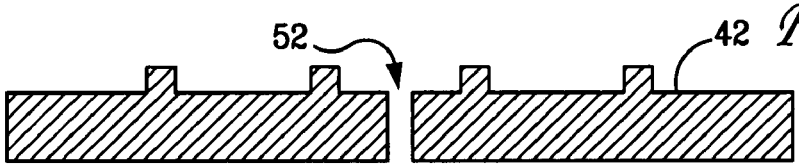
FIG. 4B presents a cross-sectional view taken through line 4B-4B of FIG. 4A.

FIG. 4A presents a plan view of a preferred embodiment of orifice plate 42. As shown, orifice plate 42 includes an inner sealing ring 46 and an outer landing ring 48 to inhibit the flow of fuel from the outlet ends 16 of capillary passages 12 of capillary bundle 15, when orifice plate 42 is in sealing engagement with metering plate 40. As indicated, orifice plate 42 serves as a fixed member that cooperates with metering plate 40, which serves as a moving member that opens or closes the flow passage through the orifice plate 42. FIG. 4B presents a cross-sectional view taken through line 4B-4B of FIG. 4A.

Figure 5A:
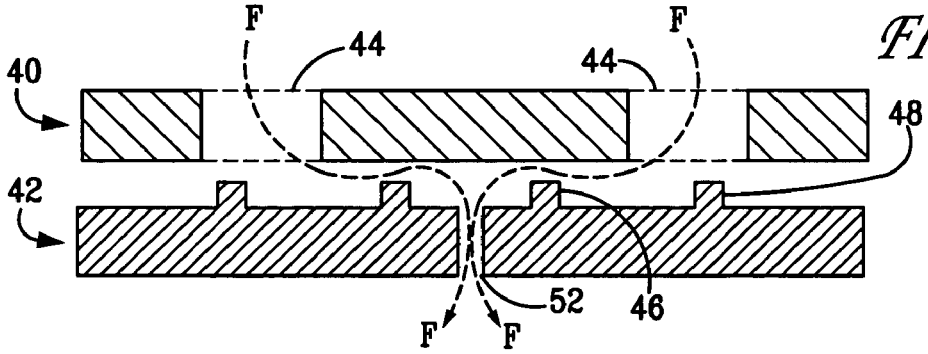
FIG. 5A depicts the cooperation of the FIG. 3B metering plate and FIG. 4B orifice plate when positioned in an open position to create a fuel flow path.
Figure 5B:
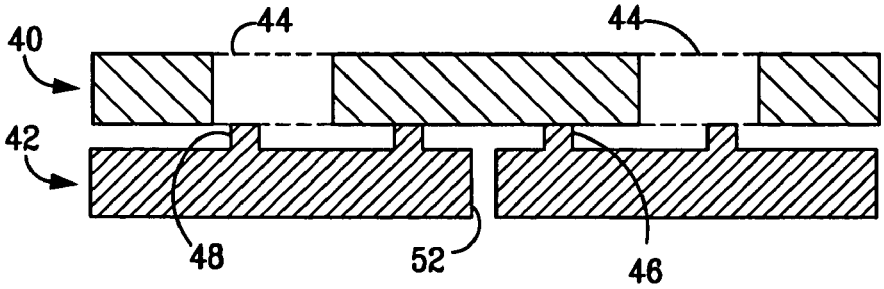
FIG. 5B depicts the cooperation of FIG. 3B metering plate and FIG. 4B orifice plate when positioned in the closed position to seal off the flow of fuel.

FIG. 5A depicts the cooperation of metering plate 40 and orifice plate 42 when positioned in an open position to create a flow path for the fuel flowing through the capillary bundle 15. FIG. 5B depicts the cooperation of metering plate 40 and orifice plate 42 when positioned in the closed position to seal off the flow of fuel from the capillary bundle 15.

Figure 6:
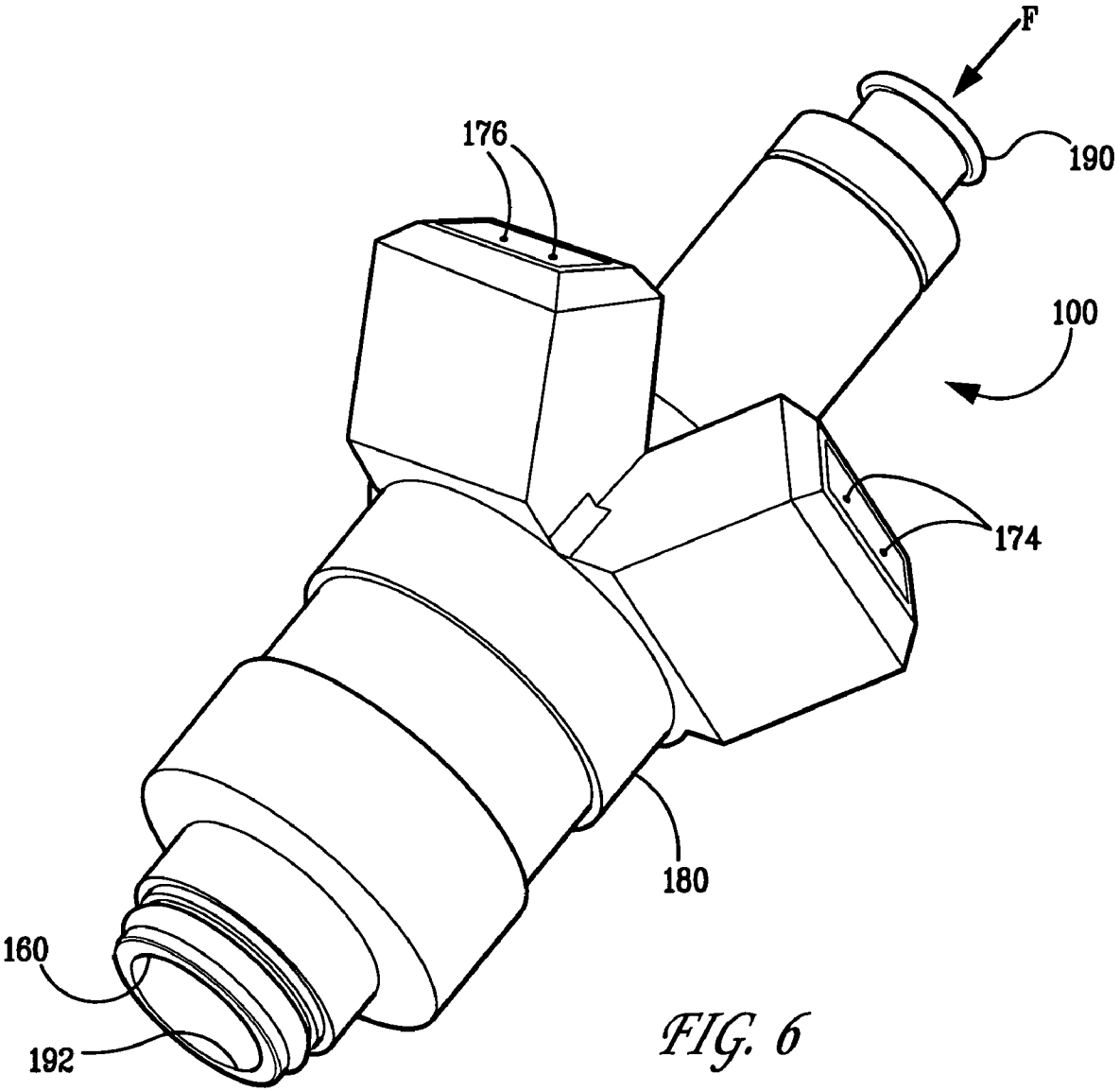
FIG. 6 shows an isometric view of another multiple capillary fuel injector having an electronically heated capillary bundle positioned upstream of a solenoid activated fuel metering valve, in accordance with another preferred form of the injector.
Figure 7:
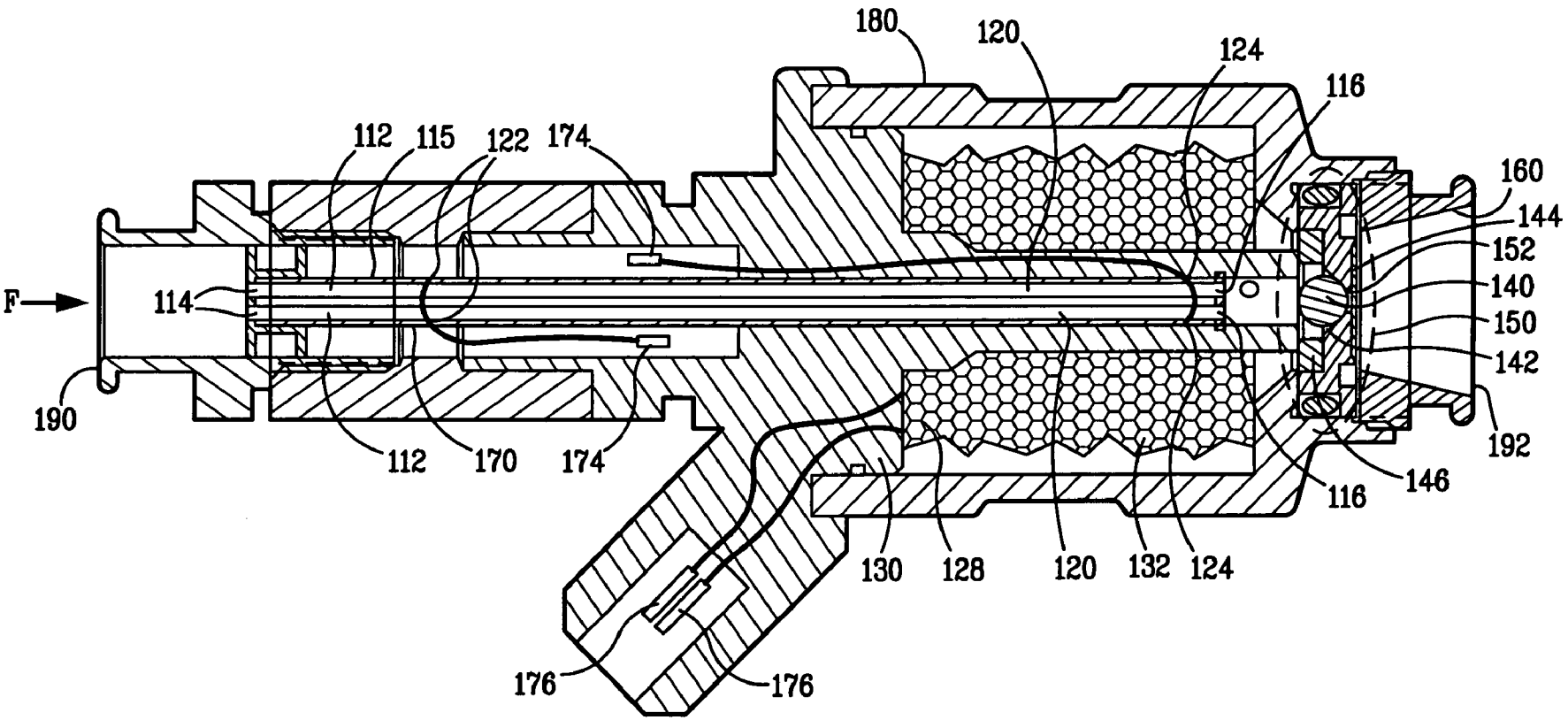
FIG. 7 is a partial cross-sectional side view of the multiple capillary fuel injector of FIG. 6.

Referring now to FIGS. 6 and 7, another embodiment of a fuel injector 100 for vaporizing liquid fuel is presented. Fuel injector 100 has an inlet 190 and outlet 192, which may advantageously be designed in a manner similar to conventional port fuel injectors, so as to be substantially interchangeable therewith. As is particularly preferred, this embodiment possesses a ball-in-cone valve assembly 144. A capillary bundle 115 similar to the type shown in FIG. 2 is positionable within central bore 170.

Capillary bundle 115 is shown having a plurality of capillary flow passages 112, each having an inlet end 114 and an outlet end 116, with the inlet end 114 in fluid communication with a liquid fuel source F. A heat source 120 is arranged along each capillary flow passage 112. As is most preferred, each heat source 120 is provided by forming capillary flow passage 112 from a tube of electrically resistive material, a portion of each capillary flow passage 112 forming a heater element when a source of electrical current is connected to the tube at electrical connections 122 and 124 for delivering current therethrough. Each heat source 120, as may be appreciated, is then operable to heat the liquid fuel in each capillary flow passage 112 to a level sufficient to change at least a portion thereof from a liquid state to a vapor state and deliver a stream of substantially vaporized fuel from outlet end 116 of each capillary flow passage 112. Once again, this method of vapor delivery into the body of the injector minimizes the surface area of the material that comes into contact with the vaporized fuel and, therefore, also minimizes the thermal mass that must be heated in order to prevent premature condensation of the vapor.

As in the FIG. 1 embodiment, capillary bundle 115 may consist of from 2 to 4 thin-walled capillary flow passages 12 (0.032" outer diameter (OD) and 0.028-0.029" inner diameter (ID)). Capillary flow passages 112 may be constructed from stainless steel or annealed Inconel 600 tubes, each having a heated length 120 of from about 1.25" to about 2.50". When current is supplied to capillary bundle 115, the heated source 120 of each capillary passage 112 becomes hot and subsequently vaporizes fuel as the fuel flows through the capillary passages 112.

One method having utility in the attaching of the capillary bundle 115 in the region of the ball-in-cone valve assembly 144 is through the use of laser welding. Specifically, the capillary passages 112 are laser welded onto a securing disk, where the capillary passages 112 extend through the thickness of the disk. This securing disk is then welded to the inner diameter of the central bore 170 that extends down the centerline of the injector 100. As may be appreciated, the capillary passages 112 are secured in position through this welding process. Once again, although this method of attachment does not result in thermal isolation of the capillaries from the metal portion of the injector 100, the resultant increase in thermal mass is not considered to be significant since the flow path is relatively small (i.e., the point of connection between the securing disk and the centerline passage is small). However, it should be recognized that a thermally insulating material could also be used to hold the securing disk in place.

As with the embodiments of FIGS. 1-5, a brazing technique may be used to attach the capillary bundle 115 in the region of the ball-in-cone valve assembly 144. Through this technique, a cup-and-disk apparatus is used to secure the outlet ends 16 of the capillary passages 112 in place. The cup portion of this assembly consists of a short cylindrical piece of metal, into which the outlet ends 116 of the capillary passages 112 are fit. The ends of the capillary passages are then brazed to the inner diameter of the cup. The end of the cup closest to the ball-in-cone valve assembly 144 is flared out such that it is perpendicular to the axis of the cylinder. This cup portion is then brazed to the inner diameter of a separate disk. A separate method is used to ensure that there is no fluid flow path between the disk and the fuel injector housing 180. Some examples of such methods include the use of a soft weld to create a physical connection between the disk and the fuel injector housing 180 or the use of an O-ring. It should be noted that the non-magnetic property of the braze, the magnetic properties of the cup and the disk, and the orientation and thickness of each piece in this assembly are designed to act as part of the magnetic circuit of the fuel injector 100.

Referring to FIG. 7, a low-mass ball valve assembly 144 is operated by solenoid 128. Solenoid 128 has coil windings 132 connected to electrical connectors 176. When the coil windings 132 are energized, a magnetic field is directed through plate 146, which is connected to ball 140, thereby causing it to lift from conical sealing surface 142, exposing an orifice 152, and allowing fuel to flow. When electricity is cut off from the coil windings 132, a spring (not shown) returns the plate 146 and attached ball 140 to their original position.

In an alternate embodiment, a solenoid element (not shown) could be drawn into the center of coil windings 132 to lift ball 140, which could be connected to the solenoid element. Movement of the solenoid element, caused by applying electricity to the coil windings 132, would cause the ball 40 to be drawn away from conical sealing surface 142, exposing an orifice 152, and allowing fuel to flow. Again, when electricity is cut off from the coil windings 132, a spring (not shown) returns the ball 140 to its original position.

The spring is dimensioned such that the force of the spring pushing the ball against the conical section of the injector exit is sufficient to block the flow of the pressurized liquid fuel in the injector.

Referring still to FIG. 7, upon exiting the outlet ends 116 of capillary passages 112, fuel flow is directed toward ball-in-valve assembly 144 of fuel injector 100. As with conventional fuel injectors, the metering section 150 consists of a solenoid operated ball-in-cone metering valve assembly 144. The act of actuating the solenoid 128 to move the plate 146 and ball 140 assembly between the open and closed position serves to meter the flow of fuel exiting the injector 100. Upon exiting the orifice 152, the fuel flows through a conical chimney section 160 to create the desired spray atomization and spray angle. The angle of the cone can span a wide range of values provided that the ball forms a seal with the surface of the cone. Chimney section 160 also serves to allow the injector 100 to satisfy overall length requirements of conventional port fuel injectors. As may be appreciated, proper operation of injector 100 is possible without the inclusion of the chimney section 160.

As may be appreciated, the ball-in-cone valve assembly 140 allows vaporized fuel flow to be metered through a metering section 150 having low thermal inertia and minimal wetted area. These features are useful for ensuring that vaporized fuel delivery is achieved with a minimal temporal delay after initial power-up. These features have been found to also mitigate against premature recondensation of fuel vapor as it exits the injector 100. This ensures that minimal droplet sizes are achieved during steady-state operation of the injector 100 when operated in the fuel vaporizer mode. Nevertheless, it should be readily recognized that the ball-in-cone valve assembly 140 depicted in FIG. 6 represents one of several valve designs that can be used in the design of the injectors of the present invention. The critical features of a suitable valve design used to meter fuel vapor are the combination of low thermal inertia and minimal wetted area. Other suitable valve designs possessing these critical features are disclosed in U.S. application Ser. No. 10/342,267, filed on Jan. 15, 2003, the contents of which are hereby incorporated by reference for all that is disclosed.

Still referring to FIG. 7, the electric circuit used to supply heat to the capillary passages 112 consists of a power supply (not shown) and a controller 2050 (see FIG. 10), capillary bundle 115, and spades 174 attached to the capillary bundle 115 to allow resistance heating of heated section 120 of the capillary passages 112. In the preferred embodiment, the capillary bundle 115 is formed through the use of a bus proximate to the inlet ends 114 of the capillary passages 112 and another bus proximate to the outlet ends 116 of the capillary passages 112 such that the entire capillary bundle 115 forms a single conductive unit. Electrical connections are made such that four spade connections 174 and 176 are molded into the bobbin 130. Two of the connections at the feed end of the bobbin 130 serve to power the solenoid 128. An additional connection at the inlet end of the bobbin 130 is attached to the inlet end of the capillary bundle 115. A fourth electrical connection is embedded through the bobbin 130 and terminates at the distal end of the bobbin 130 such that an electrical connection is made with the outlet ends 116 of the capillary bundle 115.

Figure 8:
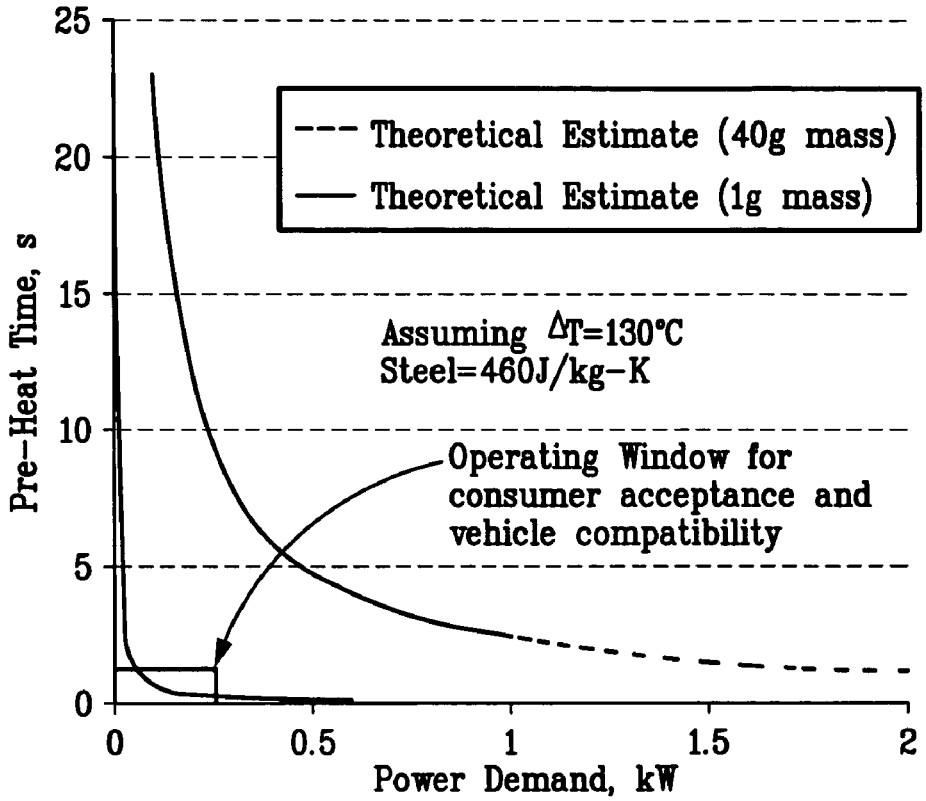
FIG. 8 is a chart illustrating the trade-off between minimizing the power supplied to the injector and minimizing the warm-up time associated with the injector for different heated masses.

To achieve vaporization in a cold engine environment, there exists a tradeoff between minimizing the power supplied to the injector for heating and minimizing the associated warm-up time, as shown in FIG. 8. As may be appreciated, the power available to heat the injector is limited to the available battery power, while the injector warm-up time is limited by consumer performance requirements.

Figure 9:
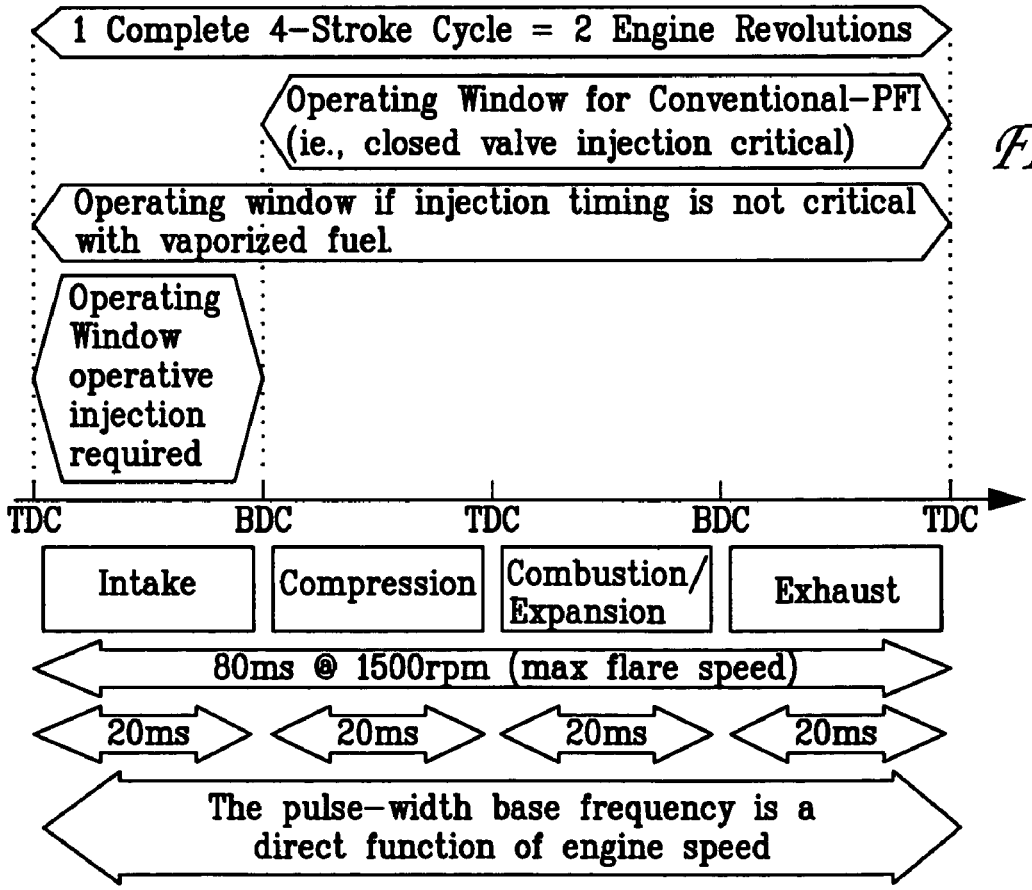
FIG. 9 is a chart illustrating that maximum emission reduction may be achieved by injecting vapor only during the portion of the engine cycle in which the intake valves are open.

In addition to the design and performance requirements outlined above, it is also necessary to have some degree of control over the fuel/air ratio as necessitated by the exhaust after-treatment scheme and/or the start-up control strategy. At a minimum, the fuel injector must have the capacity to accommodate the requisite turndown ratio, from cranking to idle to other engine operating conditions. However, in some forms, maximum emission reduction is achieved by injecting vapor only during the portion of the engine cycle in which the intake valves are open. Such an injection profile is illustrated in FIG. 9, together with the approximate times associated with each portion of a four-stroke cycle. As indicated, at 1500 rpm, open valve injection is achieved through control of the vapor flow rate such that injection occurs for 20 ms followed by a 60 ms period in which little to no vapor is delivered to the engine.

Prior valve designs used to regulate the flow of vapor fuel injectors have been known to produce an undesirable increase in the thermal mass, which is the mass that must be heated in order to achieve sufficient temperature to vaporize the liquid. This increase in thermal mass is undesirable because it increases the warm-up time of the injector (see FIG. 8) and, as such, compromises the vapor quality issued from the injector during startup and/or transient operation.

Figure 10:
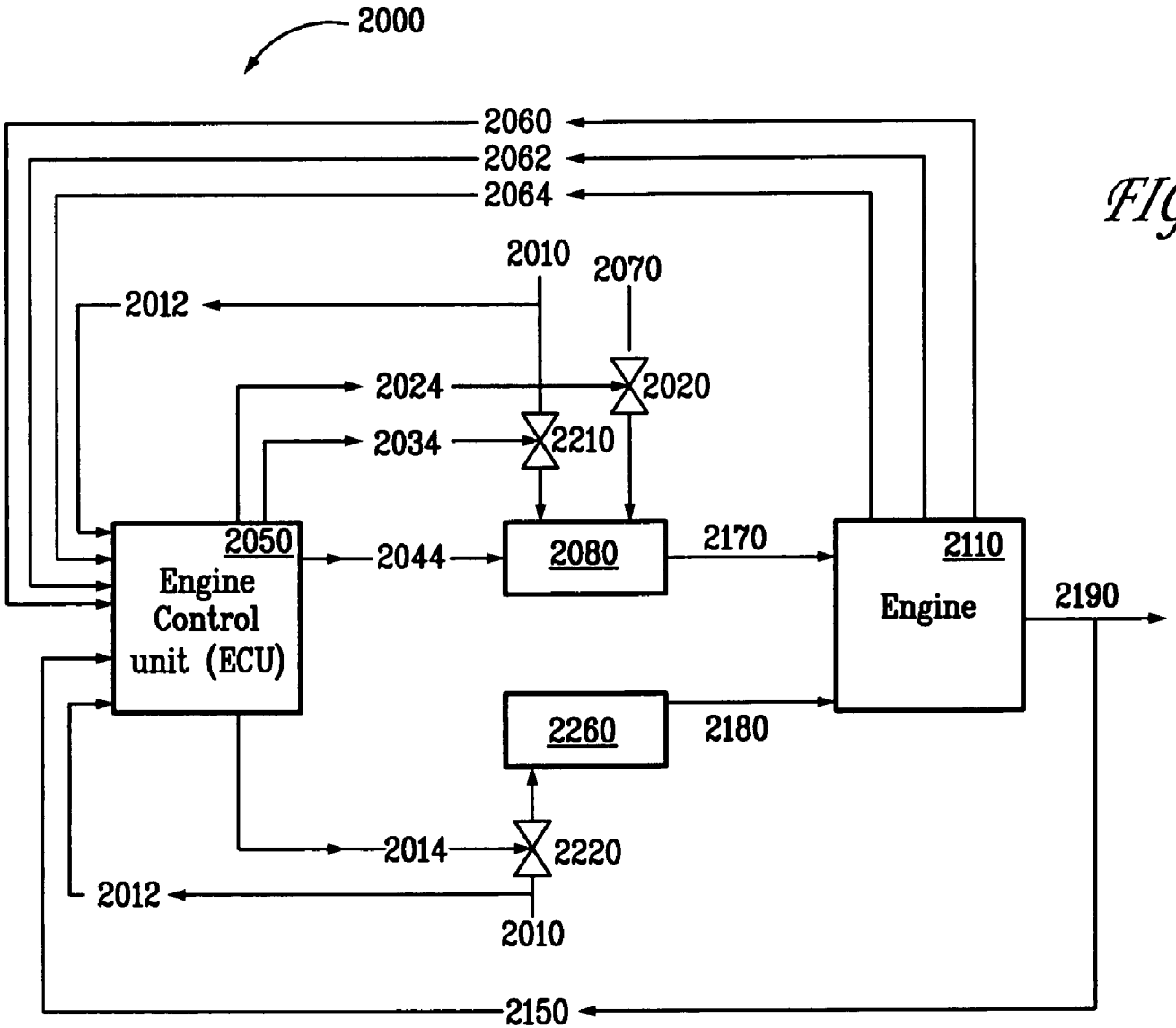
FIG. 10 is a schematic of a fuel delivery and control system, in accordance with a preferred form.

Referring now to FIG. 10, an exemplary schematic of a control system 2000 is shown. Control system 2000 is used to operate an internal combustion engine 2110 incorporating a liquid fuel supply valve 2220 in fluid communication with a liquid fuel supply 2010 and a liquid fuel injection path 2260, a vaporized fuel supply valve 2210 in fluid communication with a liquid fuel supply 2010 and capillary flow passages 2080, and an oxidizing gas supply valve 2020 in fluid communication with an oxidizing gas supply 2070 and capillary flow passages 2080. The control system includes a controller 2050, which typically receives a plurality of input signals from a variety of engine sensors such as engine speed sensor 2060, intake manifold air thermocouple and intake pressure sensor 2062, coolant temperature sensor 2064, exhaust air-fuel ratio sensor 2150, fuel supply pressure 2012, etc. In operation, the controller 2050 executes a control algorithm based on one or more input signals and subsequently generates an output signal 2024 to the oxidizer supply valve 2020 for cleaning clogged capillary passages in accordance with the invention, an output signal 2014 to the liquid fuel supply valve 2220, an output signal 2034 to the fuel supply valve 2210, and a heating power command 2044 to a power supply which delivers power to heat to the capillaries 2080.

In operation, the system herein proposed can also be configured to feed back heat produced during combustion through the use of exhaust gas recycle heating, such that the liquid fuel is heated sufficiently to substantially vaporize the liquid fuel as it passes through the capillary flow passages 2080 reducing or eliminating or supplementing the need to electrically or otherwise heat the capillary flow passages 2080.

As will be appreciated, the preferred forms of fuel injectors depicted in FIGS. 1 through 7 may also be used in connection with another embodiment of the present invention. Referring again to FIG. 1, injector 10 may also include means for cleaning deposits formed during operation of injector 10. As envisioned, the means for cleaning deposits includes placing each capillary flow passage 12 in fluid communication with a solvent, enabling the in-situ cleaning of each capillary flow passage 12 when the solvent is introduced into each capillary flow passage 12. While a wide variety of solvents have utility, the solvent may comprise liquid fuel from the liquid fuel source. In operation, the heat source should be phased-out over time or deactivated during the cleaning of capillary flow passage 12. As will be appreciated by those skilled in the art, the injector design depicted in FIGS. 6 and 7 can be easily adapted to employ in-situ solvent cleaning.

Referring again to FIG. 1, the heated capillary flow passages 12 of fuel injector 10 can produce vaporized streams of fuel, which condense in air to form a mixture of vaporized fuel, fuel droplets, and air commonly referred to as an aerosol. Likewise, referring again to FIG. 7, the heated capillary flow passages 112 of fuel injector 100 can produce vaporized streams of fuel, which condense in air to form an aerosol. Compared to conventional automotive port-fuel injectors that deliver a fuel spray comprised of droplets in the range of 150 to 200 μm Sauter Mean Diameter (SMD), the aerosol has an average droplet size of less than 25 μm SMD, preferably less than 15 μm SMD. Thus, the majority of the fuel droplets produced by the heated capillary injectors according to the invention can be carried by an air stream, regardless of the flow path, into the combustion chamber.

The difference between the droplet size distributions of a conventional injector and the fuel injectors disclosed herein is particularly critical during cold-start and warm-up conditions. Specifically, using a conventional port-fuel injector, relatively cold intake manifold components necessitate over-fueling such that a sufficient fraction of the large fuel droplets, impinging on the intake components, are vaporized to produce an ignitable fuel/air mixture. Conversely, the vaporized fuel and fine droplets produced by the fuel injectors disclosed herein are essentially unaffected by the temperature of engine components upon start-up and, as such, eliminate the need for over-fueling during engine start-up conditions. The elimination of over-fueling combined with more precise control over the fuel/air ratio to the engine afforded through the use of the fuel injectors disclosed herein results in greatly reduced cold start emissions compared to those produced by engines employing conventional fuel injector systems. In addition to a reduction in over-fueling, it should also be noted that the heated capillary injectors disclosed herein further enable fuel-lean operation during cold-start and warm-up, which results in a greater reduction in tailpipe emissions while the catalytic converter warms up.

Fuel can be supplied to the injectors disclosed herein at a pressure of less than 100 psig, preferably less than 70 psig, more preferably less than 60 psig and even more preferably less than 45 psig. It has been shown that this embodiment produces vaporized fuel that forms a distribution of aerosol droplets that mostly range in size from 2 to 30 μm SMD with an average droplet size of about 5 to 15 μm SMD, when the vaporized fuel is condensed in air at ambient temperature. The preferred size of fuel droplets to achieve rapid and nearly complete vaporization at cold-starting temperatures is less than about 25 μm. This result can be achieved by applying approximately 100 to 400W, e.g., 200W of electrical power, which corresponds to 2-3% of the energy content of the vaporized fuel to the capillary bundle. Alternatives for heating the tube along its length could include inductive heating, such as by an electrical coil positioned around the flow passage, or other sources of heat positioned relative to the flow passage to heat the length of the flow passage through one or a combination of conductive, convective or radiative heat transfer. After cold-start and warm-up, it is not necessary to heat the capillary bundle and the unheated capillaries can be used to supply adequate volumes of liquid fuel to an engine operating at normal temperature. After approximately 20 seconds (or preferably less) from starting the engine, the power used to heat the capillaries can be turned off and liquid injection initiated, for normal engine operation. Normal engine operation can be performed by liquid fuel injection via continuous injection or pulsed injection, as those skilled in the art will readily recognize.

The fuel injectors disclosed herein can be positioned in an engine intake manifold at the same location as existing port-fuel injectors or at another location along the intake manifold. The fuel injectors disclosed herein provide advantages over systems that produce larger droplets of fuel that must be injected against the back side of a closed intake valve while starting the engine. Preferably, the outlet of the capillary tube is positioned flush with the intake manifold wall similar to the arrangement of the outlets of conventional fuel injectors.

EXAMPLE

Laboratory bench tests were performed using gasoline supplied at constant pressure with a micro-diaphragm pump system for the capillaries described below. Peak droplet sizes and droplet size distributions were measured using a Spray-Tech laser diffraction system manufactured by Malvern. Droplet sizes are given in Sauter Mean Diameter (SMD). SMD is the diameter of a droplet whose surface-to-volume ratio is equal to that of the entire spray and relates to the spray's mass transfer characteristics.

Figure 11:
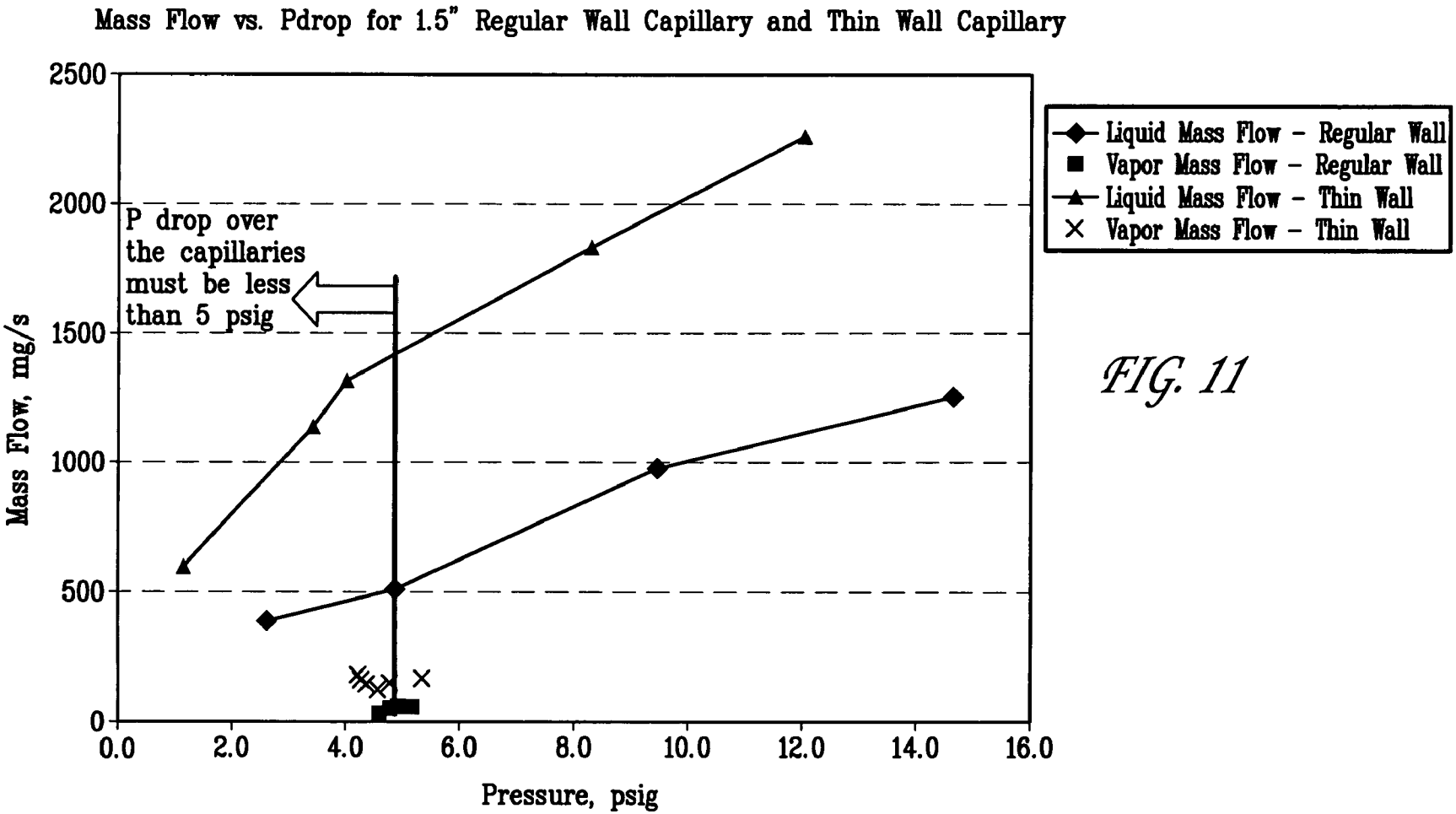
FIG. 11 presents the liquid mass flow rate and vapor mass flow rate of fuel through a single 1.5" capillary as a function of the pressure drop over the capillary.

FIG. 11 presents the liquid mass flow rate and vapor mass flow rate of fuel through a single 1.5" capillary as a function of the pressure drop over the capillary. In FIG. 11, flow through a "regular wall" (0.032 OD, 0.020 ID) capillary is compared to flow through a "thin wall" (0.032 OD, 0.028-0.029 ID) capillary. For the results shown in FIG. 11, each capillary was constructed of 304 stainless steel, although it should be readily recognized that similar results are achievable with Inconel 600. A critical difference between the use of stainless steel 304 and Inconel 600 in this application is the electrical resistivity of each material. Specifically, Inconel 600 has a higher resistivity than stainless steel 304 and, therefore, is better suited to the present application where higher resistivity is essential for compatibility with the electrical circuit used to supply heat to the capillaries.

As indicated in FIG. 11, the increased flow area of the "thin wall" capillary results in significant increases in both liquid and vapor mass flow rate compared to the "regular wall" capillary. The solid vertical line on the graph represents a design point based on a total fuel injector pressure of 50 psig and a requirement of less than 10% pressure drop over the capillary. At this design point, the results in FIG. 11 indicate that the liquid and vapor flow rate requirements for most automotive port fuel injection applications can be met with 2-4 thin-walled, 1.5" capillaries.

Figure 12:
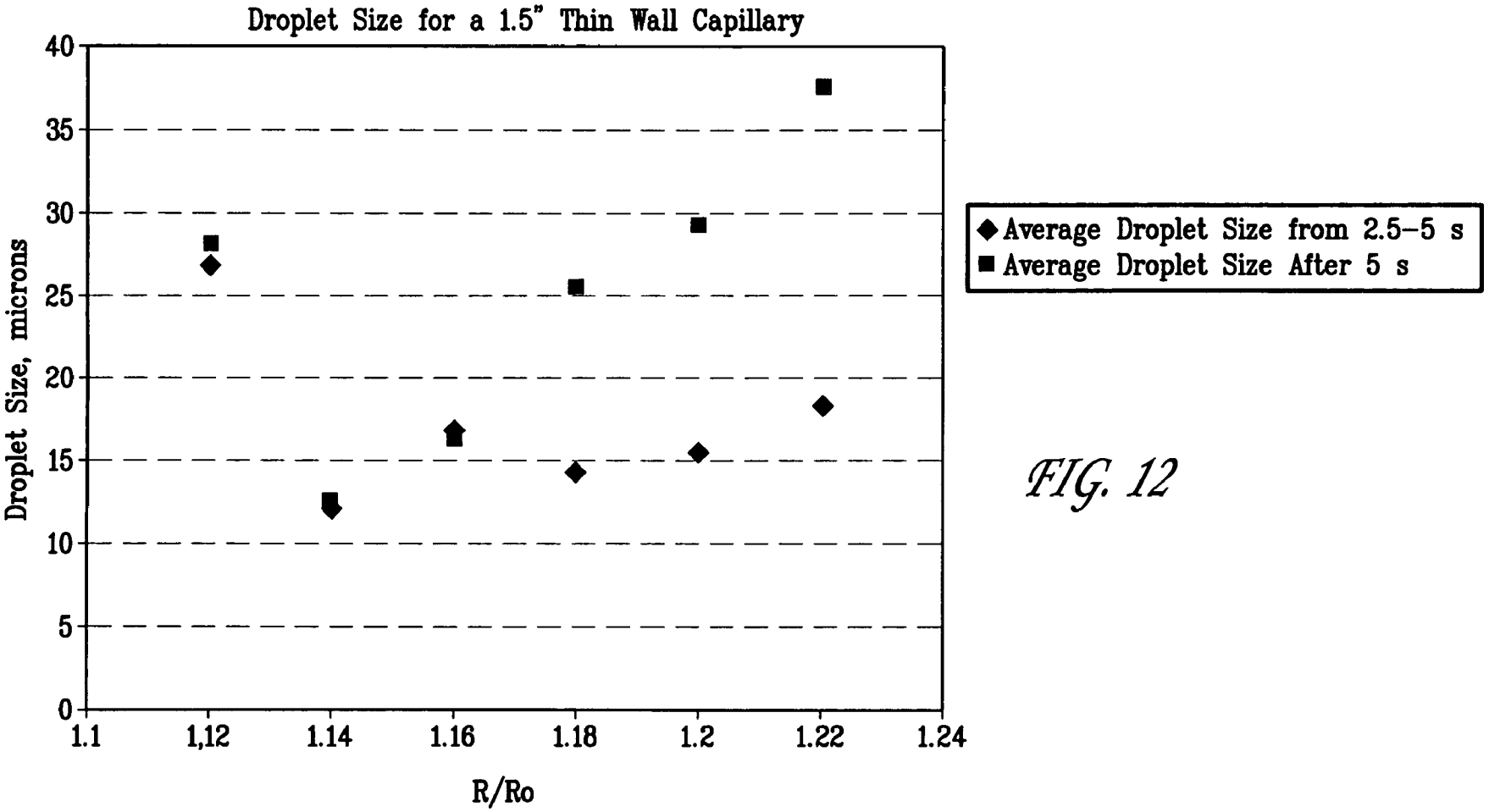
FIG. 12 presents fuel droplet size (SMD in microns) as a function of the resistance set-point of a 1.5" thin wall capillary.

FIG. 12 presents fuel droplet size (SMD in microns) as a function of the resistance set-point of a 1.5" thin wall capillary. The results indicate that the droplet sizes vary significantly with the temperature set-point of the capillary expressed as the ratio of the heated capillary resistance (R) to the cold capillary resistance (Ro). However, the preferred range for the temperature set-point of the stainless steel capillary is around an R/Ro value of 1.12 to 1.2. For stainless steel, this range corresponds to a bulk capillary temperature on the order of 140° C. to 220° C.

While the subject invention has been illustrated and described in detail in the drawings and foregoing description, the disclosed embodiments are illustrative and not restrictive in character. All changes and modifications that come within the scope of the invention are desired to be protected.

What is claimed is:

1. A fuel injector for vaporizing and metering a liquid fuel to an internal combustion engine, comprising:

(a) a plurality of capillary flow passages, each of said plurality of capillary flow passages having an inlet end and an outlet end;

(b) a heat source arranged along each of said plurality of capillary flow passages, said heat source operable to heat the liquid fuel in each of said plurality of capillary flow passages to a level sufficient to change at least a portion thereof from the liquid state to a vapor state and deliver a stream of substantially vaporized fuel from each said outlet end of said plurality of capillary flow passages; and (c) a valve for metering substantially vaporized fuel to the internal combustion engine, said valve located proximate to each said outlet end of said plurality of capillary flow passages.

2. The fuel injector of claim 1, wherein said valve for metering fuel to the internal combustion engine is a low-mass plate valve assembly having a low wetted area operated by a solenoid.

3. The fuel injector of claim 2, wherein said low-mass plate valve assembly comprises a metering plate and an orifice plate.

4. The fuel injector of claim 3, wherein said metering plate includes a plurality of metering apertures to permit fuel to pass from each said outlet end of said plurality of capillary passages.

5. The fuel injector of claim 4, wherein said orifice plate includes an inner sealing ring and an outer landing ring to inhibit fuel flow from each said outlet end of said plurality of capillary passages when said orifice plate is in sealing engagement with said metering plate.

6. The fuel injector of claim 1, wherein said valve for metering fuel to the internal combustion engine is a low-mass ball valve assembly operated by a solenoid.

7. The fuel injector of claim 6, wherein said low-mass ball valve assembly comprises a ball connected to said solenoid and a conical sealing surface.

8. The fuel injector of claim 7, wherein said low-mass ball valve assembly further comprises a spring dimensioned to provide a spring force operable to push said ball against said conical section and block fluid flow from the injector.

9. The fuel injector of claim 8, further comprising an exit orifice, wherein movement of said solenoid caused by applying electricity to said solenoid causes said ball to be drawn away from said conical sealing surface, allowing fuel to flow through said exit orifice.

10. The fuel injector of claim 1, wherein each of said plurality of capillary flow passages are formed within a tube selected from the group consisting of stainless steel and Inconel.

11. The fuel injector of claim 10, wherein said plurality of capillary flow passages have an internal diameter from about 0.020 to about 0.030 inches and a length of from about 1 to about 3 inches.

12. The fuel injector of claim 1, further comprising:

(d) means for cleaning deposits formed during operation of the injector.

13. The fuel injector of claim 10, wherein said means for cleaning deposits employs a solvent comprising liquid fuel from the liquid fuel source and wherein the heat source is phased-out during cleaning of said capillary flow passage.

14. The fuel injector of claim 1, further comprising a nozzle to atomize a portion of the liquid fuel.

15. The fuel injector of claim 1, wherein said heat source includes a resistance heater.

16. The fuel injector of claim 1, wherein said valve for metering fuel to the internal combustion engine is positioned downstream of each said outlet end of said plurality of capillary flow passages.

17. The fuel injector of claim 1, whereby the stream of substantially vaporized fuel from each said outlet end of said plurality of capillary flow passages is introduced upstream of said valve for metering fuel.

18. The fuel injector of claim 1, wherein the internal combustion engine is an alcohol-fueled engine.

19. The fuel injector of claim 1, wherein the internal combustion engine is a gasoline direct-injection engine.

20. The fuel injector of claim 1, wherein the internal combustion engine is part of a hybrid-electric engine.

21. A fuel system for use in an internal combustion engine, comprising (a) a plurality of fuel injectors, each injector including (i) a plurality of capillary flow passages, each of said plurality of capillary flow passages having an inlet end and an outlet end; (ii) a heat source arranged along each of said plurality of capillary flow passages, said heat source operable to heat the liquid fuel in each of said plurality of capillary flow passages to a level sufficient to change at least a portion thereof from the liquid state to a vapor state and deliver a stream of substantially vaporized fuel from each said outlet end of said plurality of capillary flow passages; and (iii) a valve for metering substantially vaporized fuel to the internal combustion engine, said valve located proximate to each said outlet end of said plurality of capillary flow passages;

(b) a liquid fuel supply system in fluid communication with said plurality of fuel injectors; and (c) a controller to control the supply of fuel to said plurality of fuel injectors.

22. The fuel system of claim 21, wherein said valve for metering fuel to the internal combustion engine is a low-mass plate valve assembly having a low welted area operated by a solenoid.

23. The fuel system of claim 22, wherein said low-mass plate valve assembly comprises a metering plate and an orifice plate.

24. The fuel system of claim 23, wherein said metering plate includes a plurality of metering apertures to permit fuel to pass from each said outlet end of said plurality of capillary passages.

25. The fuel system of claim 24, wherein said orifice plate includes an inner sealing ring and an outer landing ring to inhibit fuel flow from each said outlet end of said plurality of capillary passages when said orifice plate is in sealing engagement with said metering plate.

26. The fuel system of claim 21, wherein said valve for metering fuel to the internal combustion engine is a low-mass ball valve assembly operated by a solenoid.

27. The fuel system of claim 26, wherein said low-mass ball valve assembly comprises a ball connected to said solenoid and a conical sealing surface.

28. The fuel system of claim 27, wherein said low-mass ball valve assembly further comprises a spring dimensioned to provide a spring force operable to push said ball against said conical section and block fluid flow from the injector.

29. The fuel system of claim 28, further comprising an exit orifice, wherein movement of said solenoid caused by applying electricity to said solenoid causes said ball to be drawn away from said conical sealing surface, allowing fuel to flow through said exit orifice.

30. The fuel system of claim 21, wherein each of said plurality of capillary flow passages are formed within a tube selected from the group consisting of stainless steel and Inconel.

31. The fuel system of claim 30, wherein each of said plurality of capillary flow passages has an internal diameter of from about 0.020 to about 0.030 inches and a length of from about 1 to about 3 inches.

32. The fuel system of claim 21, further comprising:

(d) means for cleaning deposits formed during operation of the injector.

33. The fuel system of claim 30, wherein said means for cleaning deposits employs a solvent comprising liquid fuel from the liquid fuel source and wherein the heat source is phased-out during cleaning of said capillary flow passage.

34. The fuel system of claim 21, further comprising a nozzle to atomize a portion of the liquid fuel.

35. The fuel system of claim 21, wherein said heat source includes a resistance heater.

36. The fuel system of claim 21, wherein said valve for metering fuel to the internal combustion engine is positioned downstream of each said outlet end of said plurality of capillary flow passages.

37. The fuel system of claim 21, whereby the stream of substantially vaporized fuel from each said outlet end of said plurality of capillary flow passages is introduced upstream of said valve for metering fuel.

38. The fuel system of claim 21, wherein the internal combustion engine is an alcohol-fueled engine.

39. The fuel system of claim 21, wherein the internal combustion engine is a gasoline direct-injection engine.

40. The fuel system of claim 21, wherein the internal combustion engine is part of a hybrid-electric engine.

41. A method of delivering fuel to an internal combustion engine, comprising the steps of:

(a) supplying liquid fuel to a plurality of capillary flow passages of a fuel injector;

(b) causing a stream of substantially vaporized fuel to pass through each outlet of the plurality of capillary flow passages by heating the liquid fuel in the plurality of capillary flow passages; and (c) metering the substantially vaporized fuel to a combustion chamber of the internal combustion engine through a valve located proximate to each outlet of the plurality of capillary flow passages.

42. The method of claim 41, wherein said delivery of substantially vaporized fuel to the combustion chamber of the internal combustion engine is limited to start-up and warm-up of the internal combustion engine.

43. The method of claim 42, wherein a stream of substantially vaporized fuel is delivered to each combustion chamber of the internal combustion engine.

44. The method of claim 41, wherein a stream of substantially vaporized fuel is delivered to each combustion chamber of the internal combustion engine.

45. The method of claim 42, further comprising delivering liquid fuel to the combustion chamber of the internal combustion engine when the internal combustion engine is at a fully warmed condition.

46. The method of claim 41, further comprising cleaning periodically the plurality of capillary flow passages.

47. The method of claim 46, wherein said periodic cleaning comprises (i) phasing-out said heating of the plurality of capillary flow passages, (ii) supplying a solvent to the plurality of capillary flow passages, whereby deposits formed in the plurality of capillary flow passages are substantially removed.

48. The method of claim 47, wherein the solvent includes liquid fuel from the liquid fuel source.

49. The method of claim 41, wherein the stream of substantially vaporized fuel mixes with air and forms an aerosol in the combustion chamber prior to start up of combustion, the method including forming the aerosol with a particle size distribution, a fraction of which is 25 μm or less prior to igniting the substantially vaporized fuel to initiate combustion.

50. The method of claim 41, wherein in step (c) the valve for metering fuel to the internal combustion engine is a low-mass plate valve assembly having a low wetted area operated by a solenoid.

51. The method of claim 50, wherein the low-mass plate valve assembly includes a metering plate and an orifice plate.

52. The method of claim 51, wherein the metering plate includes a plurality of metering apertures to permit fuel to pass from each outlet of the plurality of capillary passages.

53. The method of claim 52, wherein the orifice plate includes an inner sealing ring and an outer landing ring to inhibit fuel flow from each outlet of the plurality of capillary passages when the orifice plate is in sealing engagement with the metering plate.

54. The method of claim 41, wherein in step (c) the valve for metering fuel to the internal combustion engine is a low-mass ball valve assembly operated by a solenoid.

55. The method of claim 54, wherein the low-mass ball valve assembly comprises a ball connected to the solenoid and a conical sealing surface.

56. The method of claim 55, wherein the low-mass ball valve assembly further comprises a spring dimensioned to provide a spring force operable to push the ball against the conical section and block fluid flow from the injector.

57. The method of claim 56, wherein movement of the solenoid caused by applying electricity to the solenoid causes the ball to be drawn away from the conical sealing surface, allowing fuel to flow through an exit orifice.

58. The method of claim 41, wherein each of the plurality of capillary flow passages are formed within a tube selected from the group consisting of stainless steel and Inconel.

59. The method of claim 58, wherein each of the plurality of capillary flow passages have an internal diameter of from about 0.020 to about 0.030 inches and a length of from about 1 to about 3 inches.

60. The method of claim 41, wherein in step (b) said heating is achieved through the use of a resistance heater.

61. The method of claim 41, wherein in step (c) the valve for metering fuel to the internal combustion engine is positioned downstream of each outlet of the plurality of capillary flow passages.

62. The method of claim 41, whereby the stream of substantially vaporized fuel from each outlet of the plurality of capillary flow passages is introduced upstream of the valve for metering fuel.

63. The method of claim 41, wherein the internal combustion engine is an alcohol-fueled engine.

64. The method of claim 41, wherein the internal combustion engine is a gasoline direct-injection engine.

65. The method of claim 41, wherein the internal combustion engine is part of a hybrid-electric engine.

66. A method of delivering vaporized fuel to an internal combustion engine, comprising the steps of:

(a) supplying liquid fuel to a plurality of capillary flow passages of a fuel injector;

(b) heating the liquid fuel within the plurality of capillary flow passages of the fuel injector and causing vaporized fuel to pass through each outlet of the plurality of capillary flow passages; and (c) metering the vaporized fuel to a combustion chamber of the internal combustion engine through a valve located downstream of each outlet of the plurality of capillary flow passages.

67. The method of claim 66, wherein said step of metering vaporized fuel to the combustion chamber of the internal combustion engine is limited to start-up and warm-up of the internal combustion engine.

68. The method of claim 67, wherein vaporized fuel is metered to each combustion chamber of the internal combustion engine.

69. The method of claim 66, wherein vaporized fuel is metered to each combustion chamber of the internal combustion engine.

70. The method of claim 67, further comprising delivering liquid fuel to the combustion chamber of the internal combustion engine when the internal combustion engine is at a fully warmed condition.

71. The method of claim 66, further comprising cleaning periodically the plurality of capillary flow passages.

72. The method of claim 71, wherein said periodic cleaning comprises (i) phasing-out said heating of the plurality of capillary flow passages, (ii) supplying a solvent to the plurality of capillary flow passages, whereby deposits formed in the plurality of capillary flow passages are substantially removed.

73. The method of claim 72, wherein the solvent includes liquid fuel from the liquid fuel source.

74. The method of claim 66, wherein the stream of vaporized fuel mixes with air and forms an aerosol in the combustion chamber prior to start up of combustion, the method including forming the aerosol with a particle size distribution, a fraction of which is 25 μm or less prior to igniting the vaporized fuel to initiate combustion.

75. The method of claim 66, wherein in step (c) the valve for metering fuel to the internal combustion engine is a low-mass plate valve assembly having a low wetted area operated by a solenoid.

76. The method of claim 75, wherein the low-mass plate valve assembly includes a metering plate and an orifice plate.

77. The method of claim 76, wherein the metering plate includes a plurality of metering apertures to permit fuel to pass from each outlet of the plurality of capillary passages.

78. The method of claim 77, wherein the orifice plate includes an inner sealing ring and an outer landing ring to inhibit fuel flow from each outlet of the plurality of capillary passages when the orifice plate is in sealing engagement with the metering plate.

79. The method of claim 66, wherein in step (c) the valve for metering fuel to the internal combustion engine is a low-mass ball valve assembly operated by a solenoid.

80. The method of claim 79, wherein the low-mass ball valve assembly comprises a ball connected to the solenoid and a conical sealing surface.

81. The method of claim 80, wherein the low-mass ball valve assembly further comprises a spring dimensioned to provide a spring force operable to push the ball against the conical section and block fluid flow from the injector.

82. The method of claim 81, wherein movement of the solenoid caused by applying electricity to the solenoid causes the ball to be drawn away from the conical sealing surface, allowing fuel to flow through an exit orifice.

83. The method of claim 66, wherein each of the plurality of capillary flow passages are formed within a tube selected from the group consisting of stainless steel and Inconel.

84. The method of claim 83, wherein each of the plurality of capillary flow passages has an internal diameter of from about 0.020 to about 0.030 inches.

85. The method of claim 83, wherein each of the plurality of capillary flow passages has a length of from about 1 to about 3 inches.

86. The method of claim 66, wherein in step (b) said heating is achieved through the use of a resistance heater.

87. The method of claim 66, whereby the vaporized fuel from each outlet of the plurality of capillary flow passages is introduced upstream of the valve for metering fuel.

88. The method of claim 66, wherein the internal combustion engine is an alcohol-fueled engine.

89. The method of claim 66, wherein the internal combustion engine is a gasoline direct-injection engine.

90. The method of claim 66, wherein the internal combustion engine is part of a hybrid-electric engine.

* * * * *